US010854152B2

(12) United States Patent
Ito et al.

(10) Patent No.: US 10,854,152 B2
(45) Date of Patent: Dec. 1, 2020

(54) DISPLAY DRIVER, DISPLAY CONTROLLER, ELECTRO-OPTICAL DEVICE, AND ELECTRONIC APPARATUS FOR REDUCING MEMORY SIZE OF A MEMORY THEREOF

(71) Applicant: SEIKO EPSON CORPORATION, Tokyo (JP)

(72) Inventors: Akihiko Ito, Tatsuno-machi (JP); Masahiko Miura, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 39 days.

(21) Appl. No.: 16/048,647

(22) Filed: Jul. 30, 2018

(65) Prior Publication Data

US 2019/0035343 A1 Jan. 31, 2019

(30) Foreign Application Priority Data

Jul. 31, 2017 (JP) ..... 2017-148105

(51) Int. Cl.
*G09G 3/36* (2006.01)
*G09G 5/39* (2006.01)
*G09G 3/3208* (2016.01)

(52) U.S. Cl.
CPC ..... *G09G 3/3607* (2013.01); *G09G 3/3685* (2013.01); *G09G 5/39* (2013.01); *G09G 3/3208* (2013.01); *G09G 2310/027* (2013.01); *G09G 2320/0673* (2013.01)

(58) Field of Classification Search
CPC ..... G09G 3/3607
See application file for complete search history.

(56) References Cited

U.S. PATENT DOCUMENTS 5,706,058 A * 1/1998 Okada ..... H04N 5/202 348/674
5,777,590 A * 7/1998 Saxena ..... G09G 3/3611 345/89
7,817,210 B2 * 10/2010 Ikeda ..... G09G 3/2007 348/671
2006/0077491 A1 * 4/2006 Morita ..... G09G 3/3611 358/519
2006/0087696 A1 * 4/2006 Lee ..... G09G 3/2044 358/3.13
2006/0215047 A1 * 9/2006 Miyasaka ..... H04N 5/202 348/254
2007/0279433 A1 12/2007 Huang
2008/0117228 A1 * 5/2008 Lee ..... G09G 3/20 345/602

FOREIGN PATENT DOCUMENTS

JP H09-074501 A 3/1997
JP 2006-133765 A 5/2006
JP 2006-270893 A 10/2006

* cited by examiner

*Primary Examiner* — William Boddie
*Assistant Examiner* — Andrew B Schnirel
(74) *Attorney, Agent, or Firm* — Oliff PLC

(57) ABSTRACT

A display driver includes a processing circuit that performs gray level gamma conversion processing on display data, a memory that stores correspondence information, and a drive circuit. The memory stores lower n bits of m-bit output gray level data in an output gray level group, the processing circuit generates output gray level data corresponding to the m-bit input gray level data based on lower n-bit data, and the drive circuit outputs a drive voltage based on the output gray level data.

19 Claims, 14 Drawing Sheets

| TONE | TONE VOLTAGE |
|---|---|
| 0 | $V_0$ |
| 1 | $V_1$ |
| 2 | $V_2$ |
| 3 | $V_3$ |
| ⋮ | ⋮ |
| 255 | $V_{255}$ |

FIG. 3

| SET POINT | INPUT TONE | OUTPUT TONE | OUTPUT TONE (BINARY) | TONE RANGE | RESTORATION PROCESSING |
|---|---|---|---|---|---|
| 1 | 0 | 0 | 0000 0000 | 0–63 | [7:6] ⇒ 00b |
| 2 | 8 | 12 | 0000 1100 | 0–63 | [7:6] ⇒ 00b |
| 3 | 16 | 23 | 0001 0111 | 0–63 | [7:6] ⇒ 00b |
| 4 | 32 | 40 | 0010 1000 | 0–63 | [7:6] ⇒ 00b |
| 5 | 48 | 56 | 0011 1000 | 16–79 | IF [5:4]=00b, THEN [7:6]=01b, OTHERWISE [7:6]=00b. |
| 6 | 64 | 68 | 0100 0100 | 32–95 | IF [5]=1b, THEN [7:6]=00b, OTHERWISE [7:6]=01b. |
| 7 | 80 | 79 | 0100 1111 | 48–111 | IF [5:4]=11b, THEN [7:6]=00b, OTHERWISE [7:6]=01b. |
| 8 | 96 | 91 | 0101 1011 | 64–127 | [7:6] ⇒ 01b |
| 9 | 128 | 114 | 0111 0010 | 80–143 | IF [5:4]=00b, THEN [7:6]=10b, OTHERWISE [7:6]=01b. |
| 10 | 160 | 140 | 1000 1100 | 112–175 | IF [5:4]=11b, THEN [7:6]=01b, OTHERWISE [7:6]=10b. |
| 11 | 176 | 155 | 1001 1011 | 128–191 | [7:6] ⇒ 10b |
| 12 | 192 | 172 | 1010 1100 | 144–207 | IF [5:4]=00b, THEN [7:6]=11b, OTHERWISE [7:6]=10b. |
| 13 | 208 | 191 | 1011 1111 | 160–223 | IF [5]=1b, THEN [7:6]=10b, OTHERWISE [7:6]=11b. |
| 14 | 224 | 212 | 1101 0100 | 176–239 | IF [5:4]=11b, THEN [7:6]=10b, OTHERWISE [7:6]=11b. |
| 15 | 240 | 233 | 1110 1001 | 192–255 | [7:6] ⇒ 11b |
| 16 | 248 | 245 | 1111 0101 | 192–255 | [7:6] ⇒ 11b |
| 17 | 255 | 255 | 1111 1111 | 192–255 | [7:6] ⇒ 11b |

FIG. 7

| ADDRESS | CORRESPONDENCE INFORMATION |
|---|---|
| ad1 | 00 0000 |
| ad2 | 00 1100 |
| ad3 | 01 0111 |
| ad4 | 10 1000 |
| ad5 | 11 1000 |
| ad6 | 00 0100 |
| ad7 | 00 1111 |
| ad8 | 01 1011 |
| ad9 | 11 0010 |
| ad10 | 00 1100 |
| ad11 | 01 1011 |
| ad12 | 10 1100 |
| ad13 | 11 1111 |
| ad14 | 01 0100 |
| ad15 | 10 1001 |
| ad16 | 11 0101 |
| ad17 | 11 1111 |

FIG. 8

| SET POINT | INPUT TONE | NUMBER OF BITS OF CORRESPONDENCE INFORMATION |
|---|---|---|
| 1 | 0 | 8bit |
| 2 | 8 | 7bit |
| 3 | 16 | 7bit |
| 4 | 32 | 7bit |
| 5 | 48 | 7bit |
| 6 | 64 | 7bit |
| 7 | 80 | 7bit |
| 8 | 96 | 7bit |
| 9 | 128 | 7bit |
| 10 | 160 | 7bit |
| 11 | 176 | 7bit |
| 12 | 192 | 7bit |
| 13 | 208 | 7bit |
| 14 | 224 | 7bit |
| 15 | 240 | 7bit |
| 16 | 248 | 7bit |
| 17 | 255 | 7bit |

DIFFERENCE IN OUTPUT TONE FROM PREVIOUS SET POINT

FIG. 10

| SET POINT | INPUT TONE | NUMBER OF BITS OF CORRESPONDENCE INFORMATION |
|---|---|---|
| 1 | 0 | 8bit |
| 2 | 1 | 4bit |
| 3 | 2 | 4bit |
| 4 | 3 | 4bit |
| 5 | 4 | 4bit |
| 6 | 5 | 4bit |
| 7 | 6 | 4bit |
| 8 | 7 | 4bit |
| 9 | 8 | 4bit |
| 10 | 16 | 8bit |
| 11 | 32 | 8bit |
| 12 | 48 | 8bit |
| 13 | 64 | 8bit |
| 14 | 80 | 8bit |
| 15 | 96 | 8bit |
| 16 | 128 | 8bit |
| 17 | 160 | 8bit |
| 18 | 176 | 8bit |
| 19 | 192 | 8bit |
| 20 | 208 | 8bit |
| 21 | 224 | 8bit |
| 22 | 240 | 8bit |
| 23 | 248 | 4bit |
| 24 | 249 | 4bit |
| 25 | 250 | 4bit |
| 26 | 251 | 4bit |
| 27 | 252 | 4bit |
| 28 | 253 | 4bit |
| 29 | 254 | 4bit |
| 30 | 255 | 8bit |

DIFFERENCE IN OUTPUT TONE FROM PREVIOUS SET POINT

DIFFERENCE IN OUTPUT TONE FROM NEXT SET POINT

FIG. 11

| SET POINT | INPUT TONE | NUMBER OF BITS OF CORRESPONDENCE INFORMATION |
|---|---|---|
| 1 | 0 | 8bit |
| 2 | 1 | 4bit |
| 3 | 2 | 4bit |
| 4 | 3 | 4bit |
| 5 | 4 | 4bit |
| 6 | 5 | 4bit |
| 7 | 6 | 4bit |
| 8 | 7 | 4bit |
| 9 | 8 | 4bit |
| 10 | 16 | 7bit |
| 11 | 32 | 7bit |
| 12 | 48 | 7bit |
| 13 | 64 | 7bit |
| 14 | 80 | 7bit |
| 15 | 96 | 7bit |
| 16 | 128 | 7bit |
| 17 | 160 | 7bit |
| 18 | 176 | 7bit |
| 19 | 192 | 7bit |
| 20 | 208 | 7bit |
| 21 | 224 | 7bit |
| 22 | 240 | 7bit |
| 23 | 248 | 7bit |
| 24 | 249 | 4bit |
| 25 | 250 | 4bit |
| 26 | 251 | 4bit |
| 27 | 252 | 4bit |
| 28 | 253 | 4bit |
| 29 | 254 | 4bit |
| 30 | 255 | 4bit |

DIFFERENCE IN OUTPUT TONE FROM PREVIOUS SET POINT

FIG. 12

DISPLAY DRIVER, DISPLAY CONTROLLER, ELECTRO-OPTICAL DEVICE, AND ELECTRONIC APPARATUS FOR REDUCING MEMORY SIZE OF A MEMORY THEREOF

CROSS-REFERENCE TO RELATED APPLICATION

This application is based on and claims priority under 35 U.S.C. § 119 from Japanese Patent Application No. 2017-148105, filed Jul. 31, 2017, the disclosure of which is hereby incorporated by reference herein in its entirety.

BACKGROUND

1. Technical Field

The present invention relates to a display driver, a display controller, an electro-optical device, an electronic apparatus, and the like.

2. Related Art

Nowadays, electro-optical panels such as color liquid-crystal panels are often used in electronic apparatuses such as monitors, TVs, and notebook computers. In color liquid crystal panels, each pixel is constituted by R, G, and B subpixels, for example, and one pixel, as a whole, expresses one color by combining colors of the R, G, and B subpixels. The colors of the R, G, and B subpixels are each determined by the luminance of light that passes through a color filter provided thereon. The luminance of light that passes through each color filter is determined by a voltage supplied to a corresponding source electrode (data line) of the liquid-crystal panel. This voltage is referred to as a gray level voltage. The electronic apparatus is provided with a display driver including a circuit device that drives the liquid-crystal panel by controlling the gray level voltage.

In general, the input (such as an input voltage or an input signal) and the output (such as light transmittance or brightness) in the liquid-crystal panel are not in a linear direct proportional relationship. Each liquid-crystal panel has its own specific gamma characteristic (luminance characteristic) resulting from the liquid-crystal material that is used and variations in manufacturing. Therefore, gray level voltages in which consideration is given to the characteristics of the liquid crystal panel need to be supplied to the source electrodes of the liquid-crystal panel in order to express desired gray levels.

When gamma correction is performed by digital processing, a processing circuit of a display driver (or a processing circuit of a display controller) performs correction processing on display data input from an external device (CPU of an electronic apparatus, for example), and outputs corrected display data to a drive circuit. For example, the processing circuit stores correction data in a memory as a look-up table (hereinafter, referred to as an "LUT"), and performs gamma correction by making reference to the LUT.

Due to limitation in mounting space, there is a strong demand to downsize the display driver or the display controller. Therefore, it is desirable to reduce the memory size by reducing the data amount of correction data. As a result of reducing the memory size, the size of the display driver or the like can be reduced, and the cost can be suppressed as well.

A method in which the size of the look-up table is reduced by storing color correction data regarding any two three color input signals in the LUT is disclosed in JP-A-2006-133765.

With the method disclosed in JP-A-2006-133765, since gamma conversion processing regarding one color (green, for example) is not performed, it is possible that a color will be unnatural.

SUMMARY

According to some aspects of the invention, a display driver, a display controller, an electro-optical device, an electronic apparatus, and the like can be provided that can perform highly accurate gamma conversion processing, while reducing the memory size of a memory that stores data for the gamma conversion processing.

One aspect of the invention relates to a display driver including: a processing circuit configured to perform gamma conversion processing on display data with respect to gray level; a memory that stores correspondence information between an input gray level group and an output gray level group that is used in the gamma conversion processing; and a drive circuit configured to output a data line drive voltage based on the display data subjected to the gamma conversion processing. The memory stores lower n-bit data of m-bit gray level data (m and n are each an integer of two or more and n<m) in the output gray level group, the processing circuit is configured to generate output gray level data corresponding to the m-bit input gray level data based on the lower n-bit data stored in the memory, and the drive circuit is configured to output the drive voltage based on the output gray level data.

In one aspect of the invention, data to be stored in a memory can be reduced to n-bit data that is used for outputting a drive voltage of the gray level corresponding to m-bit gray level data. In this way, reducing the amount of data to be stored in the memory and suppressing a reduction in accuracy in gamma conversion processing due to the reduction in the amount of data becomes possible.

Also, in one aspect of the invention, the m-bit gray level data in the output gray level group may be set to one value in a given gray level range that is smaller than $2^m$.

In this way, the processing circuit can appropriately generate output gray level data of the gray level corresponding to m-bit gray level data from lower n-bit data.

Also, in one aspect of the invention, the given gray level range may be a range corresponding to $2^n$ successive output gray levels.

In this way, the processing circuit can appropriately generate output gray level data of the gray level corresponding to m-bit gray level data from lower n-bit data.

Also, in one aspect of the invention, the processing circuit may perform processing for restoring the m-bit gray level data based on the lower n-bit data stored in the memory.

In this way, as a result of the processing circuit restoring m-bit gray level data from lower n-bit data, the drive circuit can generate a drive voltage corresponding to m-bit gray level data.

Also, in one aspect of the invention, when the m-bit gray level data corresponding to a first output gray level in the output gray level group is set to one value in a first gray level range, and the m-bit gray level data corresponding to a second output gray level in the output gray level group is set to one value in a second gray level range, the processing circuit may restore the m-bit gray level data corresponding to the first output gray level by performing first restoration processing based on the lower n-bit data corresponding to the first output gray level, and restore the m-bit gray level data corresponding to the second output gray level by performing second restoration processing based on the lower n-bit data corresponding to the second output gray level.

In this way, because the processing circuit performs restoration processing according to the gray level range, the processing circuit can appropriately generate output gray level data of the gray level corresponding to m-bit gray level data from lower n-bit data.

Also, in one aspect of the invention, the processing circuit may generate multi-level gray level data whose number of bits is larger than based on the m-bit gray level data that has been restored based on the lower n-bit data and the display data that has been input, and perform frame rate control based on the multi-level gray level data that has been generated.

In this way, as a result of performing frame rate control, the display driver can perform control so as to cause an electro-optical panel to display an intermediate gray level of m-bit gray level data.

Also, in one aspect of the invention, the output gray level group includes output gray levels respectively associated with first to $k^{th}$ (k is an integer of two or more) set points, and the processing circuit may perform processing for obtaining the output gray level corresponding to an input gray level between an $i^{th}$ (i is an integer that satisfies $1 \leq i < k$) set point and an $i+1^{th}$ set point by performing interpolation processing based on the output gray level group.

In this way, the memory need only store output gray levels associated with set points as the correspondence information, and therefore the memory size can be reduced.

Also, another aspect of the invention relates to a display driver including: a processing circuit configured to perform gamma conversion processing on display data with respect to gray level; and a memory that stores correspondence information between an input gray level group and an output gray level group that is used in the gamma conversion processing. The output gray level group includes first to $r^{th}$ is an integer of two or more) output gray levels, and the memory stores a difference between an $i^{th}$ (i is an integer that satisfies $1 \leq i < r$) output gray level and an $i+1^{th}$ output gray level of the first to $r^{th}$ output gray levels as the correspondence information.

In another aspect of the invention, when the input gray level group and the output gray level group are associated with each other, the memory stores a difference between a given output gray level and an adjacent output gray level as the correspondence information. The difference in output gray level is considered to be smaller than the entire gray level region of the output gray level, and therefore the number of bits of data that indicates the difference in output gray level can be reduced relative to the number of bits of data of the output gray level itself, and the memory size can be reduced.

Also, in another aspect of the invention, the output gray level group includes output gray levels associated with first to $k^{th}$ (k is an integer of two or more) set points, and the memory may store a difference between the output gray level at an $s^{th}$ (s is an integer that satisfies $1 \leq s < p$) set point and the output gray level at an $s+1^{th}$ set point as the correspondence information associated with at least a gray level set point of first to $p^{th}$ (p is an integer that satisfies $1 < p \leq k$) set points.

In this way, when pieces of correspondence information associated with a plurality of set points are to be stored, the memory can store a difference in output gray level as the correspondence information associated with each set point in at least a low gray level region (region in which the gray level is relatively small).

Also, in another aspect of the invention, the output gray level group includes output gray levels associated with first to $k^{th}$ (k is an integer of two or more) set points, and the memory may store a difference between the output gray level at a $t^{th}$ (t is an integer that satisfies $q \leq t < k$) set point and the output gray level at an $t+1^{th}$ set point as the correspondence information associated with at least a gray level set point of $q^{th}$ (q is an integer that satisfies $1 \leq q < k$) to $k^{th}$ set points.

In this way, when pieces of correspondence information associated with a plurality of set points are to be stored, the memory can store a difference in output gray level as the correspondence information associated with each set point in at least a high gray level region (region in which the gray level is relatively large).

Also, in another aspect of the invention, the output gray level group includes output gray levels associated with first to $k^{th}$ (k is an integer of two or more) set points, an input gray level interval in first to $p^{th}$ set points may be smaller than the input gray level interval in $p^{th}$ to $q^{th}$ set points (p and q are integers that satisfy $1 < p < q < k$), and the input gray level interval in $q^{th}$ to $k^{th}$ set points may be smaller than the input gray level interval in the $p^{th}$ to $q^{th}$ set points.

In this way, a small input gray level interval is set in a low gray level region and a high gray level region in which a shift in the gamma value is likely to occur, and as a result, the processing circuit can perform highly accurate gamma conversion processing.

Also, in another aspect of the invention, the output gray level group includes output gray levels associated with first to $k^{th}$ (k is an integer of two or more) set points, when p and q are integers that satisfy $1 < p < q < k$, s is an integer that satisfies $1 \leq s < p$, and t is an integer that satisfies $q \leq t < k$, the memory may store a difference between the output gray level at an $s^{th}$ set point and the output gray level at an $s+1^{th}$ set point as the correspondence information associated with at least a gray level set point of first to $p^{th}$ set points, and store a difference between the output gray level at a $t^{th}$ set point and the output gray level at an $t+1^{th}$ set point as the correspondence information associated with at least a gray level set point of $q^{th}$ to $k^{th}$ set points, and an input gray level interval in the first to $p^{th}$ set points may be smaller than the input gray level interval in $p^{th}$ to $q^{th}$ set points, and the input gray level interval in the $q^{th}$ to $k^{th}$ set points may be smaller than the input gray level interval in the $p^{th}$ to $q^{th}$ set points.

In this way, a small input gray level interval is set in a low gray level region and a high gray level region in which a shift in the gamma value is likely to occur, and as a result, the processing circuit can perform highly accurate gamma conversion processing. Furthermore, the memory stores a difference in output gray level as the correspondence information associated with each set point in the low gray level region and the high gray level region, and as a result, an increase in memory size can be suppressed.

Also, in another aspect of the invention, the memory stores m-bit (m is an integer of two or more) gray level data as the output gray level associated with at least a gray level set point of the first to $k^{th}$ set points, and the memory may be capable of storing the difference corresponding to a decimal gray level of the m-bit gray level data as the difference in the output gray level.

In this way, the display driver can perform control so as to cause an electro-optical panel to express an intermediate gray level of the m-bit gray level data.

Also, in another aspect of the invention, the processing circuit may perform processing of calculating the output gray level corresponding to a given input gray level based on the difference in the output gray level.

In this way, the processing circuit can appropriately output an output gray level corresponding to input display data.

Also, yet another aspect of the invention relates to a display controller including: a processing circuit configured to perform gamma conversion processing on display data with respect to gray level; and a memory that stores correspondence information between an input gray level group and an output gray level group that is used in the gamma conversion processing. The memory stores lower n bits of m-bit gray level data (m and n are each an integer of two or more and n<m) in the output gray level group, and the processing circuit is configured to generate the m-bit gray level data based on lower n-bit data stored in the memory.

In another aspect of the invention, the processing circuit restores m-bit gray level data based on n-bit data stored in the memory. In this way, the amount of data to be stored in the memory can be reduced, and a reduction in the accuracy of gamma conversion processing caused by the reduction in the amount of data can be suppressed.

Yet another aspect of the invention relates to an electro-optical device including the display driver according to any of the above descriptions and an electro-optical panel.

Yet another aspect of the invention relates to an electronic apparatus including the display driver according to any of the above descriptions.

Yet another aspect of the invention relates to an electronic apparatus including the display controller according to the above description.

BRIEF DESCRIPTION OF THE DRAWINGS

The invention will be described with reference to the accompanying drawings, wherein like numbers reference like elements.

FIG. 3 is a diagram illustrating correspondence relationship between gray levels and gray level voltages.

FIG. 7 shows an example of output gray levels and gray level ranges at respective set points.

FIG. 8 shows an example of correspondence information stored in a memory.

FIG. 10 shows an example of number of bits of correspondence information at each set point.

FIG. 11 shows an example of number of bits of correspondence information at each set point.

FIG. 12 shows an example of number of bits of correspondence information at each set point.

DESCRIPTION OF EXEMPLARY EMBODIMENTS

A present embodiment will be described in the following, Note that the embodiment described below are not intended to unduly limit the content of the invention recited in the claims. Also, all of the configurations described in the embodiment are not necessarily essential as solutions provided by the invention.

1. Exemplary System Configuration

Figure 1:
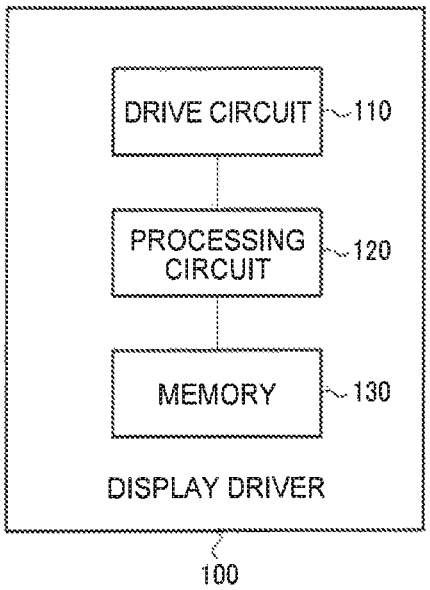
FIG. 1 shows an exemplary configuration of a display driver.

An exemplary configuration of a display driver 100 of the present embodiment is shown in FIG. 1, As shown in FIG. 1, the display driver 100 includes a processing circuit 120 that performs gamma conversion processing on display data (image data), a memory 130 that stores information regarding correspondence between an input gray level group and an output gray level group in the gamma conversion processing, and a drive circuit 110 that outputs a drive voltage of a data line based on display data subjected to gamma conversion processing. The display driver 100 is realized by an integrated circuit device (IC) or the like, for example. Note that the circuit device 100 is not limited to the configuration of FIG. 1, and various modifications are possible, such as omitting some of these constituent elements or adding other constituent elements.

Specifically, various configurations of the drive circuit 110 are known, and these configurations can be widely applied in the present embodiment. For example, in a later-described example, a D/A converter 30 of the drive circuit 110 outputs any two voltages out of 64 reference voltages $VR_0$ to $VR_{63}$, and a data line driver 40 divides a reference voltage, and as a result, a drive voltage (gray level voltage) corresponding to one of 256 gray levels is generated. Various modifications such as a configuration in which the D/A converter 30 outputs 256 reference voltages corresponding to 256 gray levels can be implemented.

1.1 Display Driver

Figure 2:
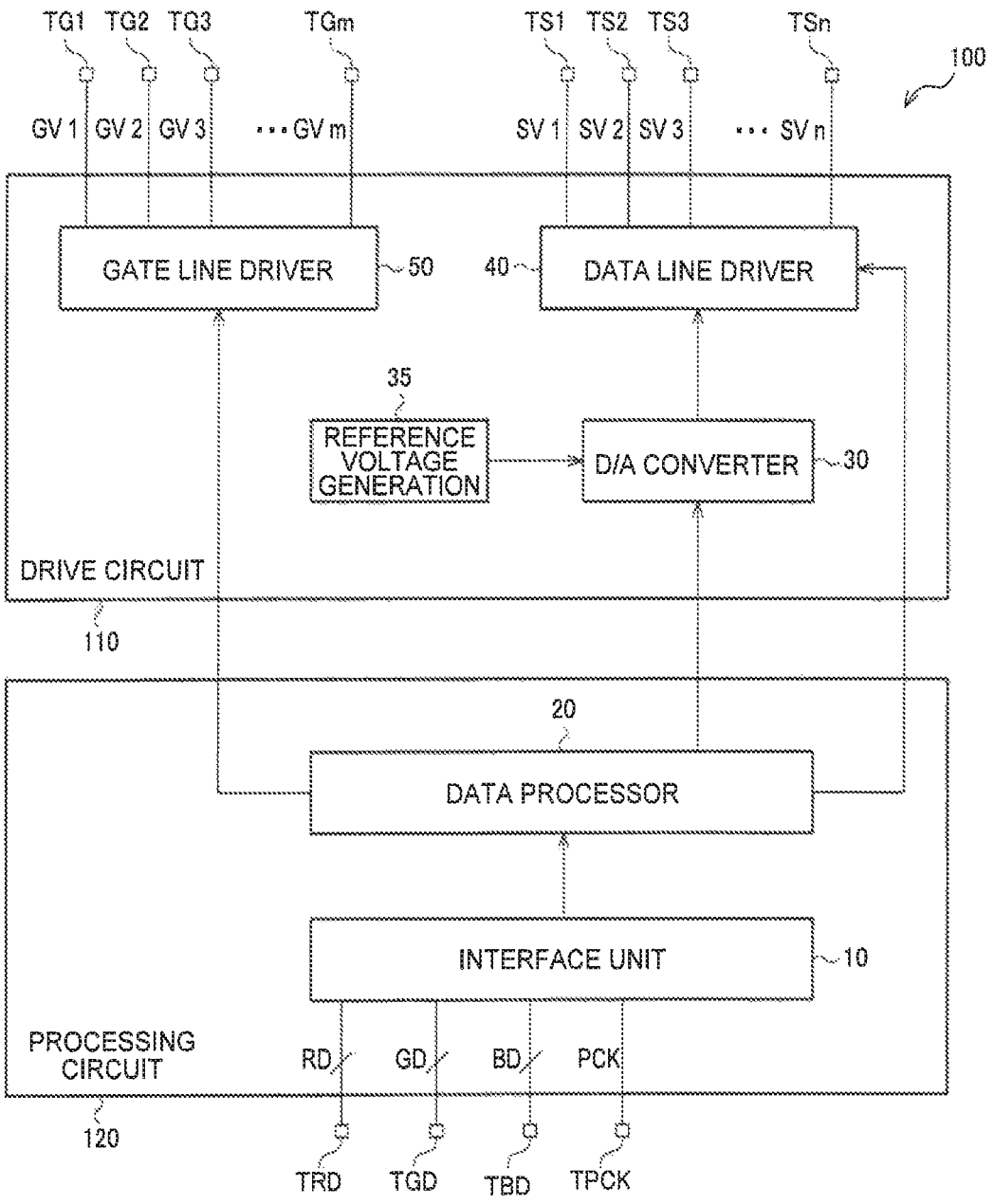
FIG. 2 shows a detailed exemplary configuration of the display driver.

FIG. 2 shows a detailed exemplary configuration of the display driver 100. The drive circuit 110 includes a reference voltage generation circuit 35 (gray level voltage generation circuit), a D/A converter 30 (D/A converter circuit), a data line driver 40 (data line drive circuit), and a gate line driver 50 (gate line drive circuit). The data line driver 40 (data line drive circuit) includes data line drive terminals (data line drive signal output terminals) TS1 to TSn (n is an integer of two or more). Also, the gate line driver 50 (gate line drive circuit) includes gate line drive terminals TG1 to TGm (m is an integer of two or more).

The processing circuit 120 includes an interface unit 10 (interface circuit, terminal) and a data processor 20 (data processing circuit).

The interface unit 10 performs communication with an external processing device. In the case where the display driver 100 is mounted in a car or the like, the processing device, here, is an ECU (Electronic Control Unit). Alternatively, when the display driver 100 is mounted in an electronic apparatus such as an information communication terminal, the processing device is a processor such as a CPU (Central Processing Unit) or a microprocessor.

The interface unit 10 includes a first color component input terminal TRD, a second color component input terminal TGD, a third color component input terminal TBD, and a clock input terminal TPCK. The communication is for transferring display data, supplying a clock signal and a synchronization signal, transferring a command (or a control signal), and the like, for example. Also, the interface unit 10 accepts a terminal setting (input level of a terminal set on a mount substrate). The interface unit 10 is constituted by an I/O buffer or the like, for example.

The data processor 20 performs data processing on display data, timing control, control of units of the display driver 100, and the like, based on display data, a clock signal, a synchronization signal, a command, and the like that are input via the interface unit 10. In the data processing on display data, the data processor 20 performs image processing such as gray level correction processing with reference to the memory 130 (LUT). In the timing control, drive timing (selection timing) of a gate line and a data line in an electro-optical panel is controlled based on the synchronization signal and the display data. The data processor 20 is constituted by a logic circuit such as a gate array, for example.

The reference voltage generation circuit 35 generates a plurality of reference voltages, and outputs the plurality of reference voltages to the D/A converter 30. For example, in a later-described example shown in FIG. 4, a plurality of reference voltages $VR_0$ to $VR_{63}$ are generated. Also, a plurality of gray level voltages are generated based on the reference voltages $VR_0$ to $VR_{63}$. For example, as shown in the table in FIG. 3, generated gray level voltages ($V_0$ to $V_{255}$) respectively correspond to a plurality of gray levels (0 to 255). Also, in the present embodiment, the reference voltages output from the reference voltage generation circuit 35 are used in common when a plurality of pieces of color component display data (first color component display data, second color component display data, third color component display data, and the like, for example) are displayed, and therefore the reference voltage generation circuit 35 need not be provided for each piece of color component display data. In this way, as a result of adopting a configuration in which the plurality of reference voltages are used in common for the first color component display data, the second color component display data, and the third color component display data, the circuit area of the reference voltage generation circuit 35 can be reduced, the layout area of reference voltage lines can be reduced, and as a result, a reduction in the scale of the display driver can be realized. Note that the reference voltage generation circuit 35 may be provided for each color.

The D/A converter 30 D/A-converts display data from the data processor 20 into a reference voltage (data voltage). For example, the D/A converter 30 includes a D/A converter circuit 32 (a plurality of voltage selection circuits) shown in FIG. 4.

The drive circuit 110 drives an electro-optical panel based on first color component display data, second color component display data, and third color component display data, which have been subjected to data processing such as gamma conversion processing, that are obtained from the data processor 20, and the plurality of gray level voltages that are obtained from the reference voltage generation circuit 35. As described above, the plurality of gray level voltages obtained from the reference voltage generation circuit 35 are used in common for the first color component display data, the second color component display data, and the third color component display data.

The data line driver 40 of the drive circuit 110 generates gray level voltages based on the reference voltage from the D/A converter 30. Also, the data line driver 40 outputs the generated gray level voltages respectively to the data line drive terminals TS1 to TSn as the data line drive voltages SV1 to SVn so as to drive data lines of the electro-optical panel. The data line drive voltages SV1 to SVn are voltages that are respectively supplied to the corresponding data line drive terminals TS1 to TSn. The gray level voltages are generated by dividing the reference voltage input from the D/A converter 30 based on the display data subjected to gamma conversion processing that is input from the data processor 20 of the processing circuit 120. Each of the voltages of the data line drive voltages SV1 to SVn is selected from the generated gray level voltages ($V_0$ to $V_{255}$, for example) by the data line driver 40 based on the display data.

Also, the data line driver 40 includes a plurality of data line drive circuits. Each data line drive circuit is provided so as to be associated with one data line drive terminal or a plurality of data line drive terminals. In the case where a data line drive circuit is provided so as to be associated with a plurality of data line drive terminals, the data line drive circuit drives the plurality of data lines in a time division manner.

The gate line driver 50 in the drive circuit 110 outputs gate line drive voltages GV1 to GVm respectively to the gate line drive terminals TG1 to TGm, and drives (selects) gate lines in the electro-optical panel. For example, in an electro-optical panel with a single gate structure, one gate line is selected in one horizontal scanning period. Alternatively, in an electro-optical panel with a dual gate structure or a triple gate structure, two or three gate lines are selected in one horizontal scanning period in a time division manner. The gate line driver 50 is constituted by a plurality of voltage output circuits (buffers, amplifiers), for example, and the voltage output circuits are provided in one-to-one correspondence with the gate line drive terminals.

The memory 130 stores various types of information that is to be used in processing performed by the processing circuit 120. For example, the memory 130 stores correction data (correspondence information) for gamma conversion processing performed by the processing circuit 120. The memory 130 can be realized by a nonvolatile memory such as a PROM (Programmable Read Only Memory). Note that the memory 130 may be a volatile memory such as an SRAM (Static Random Access Memory) or a register.

Figure 4:
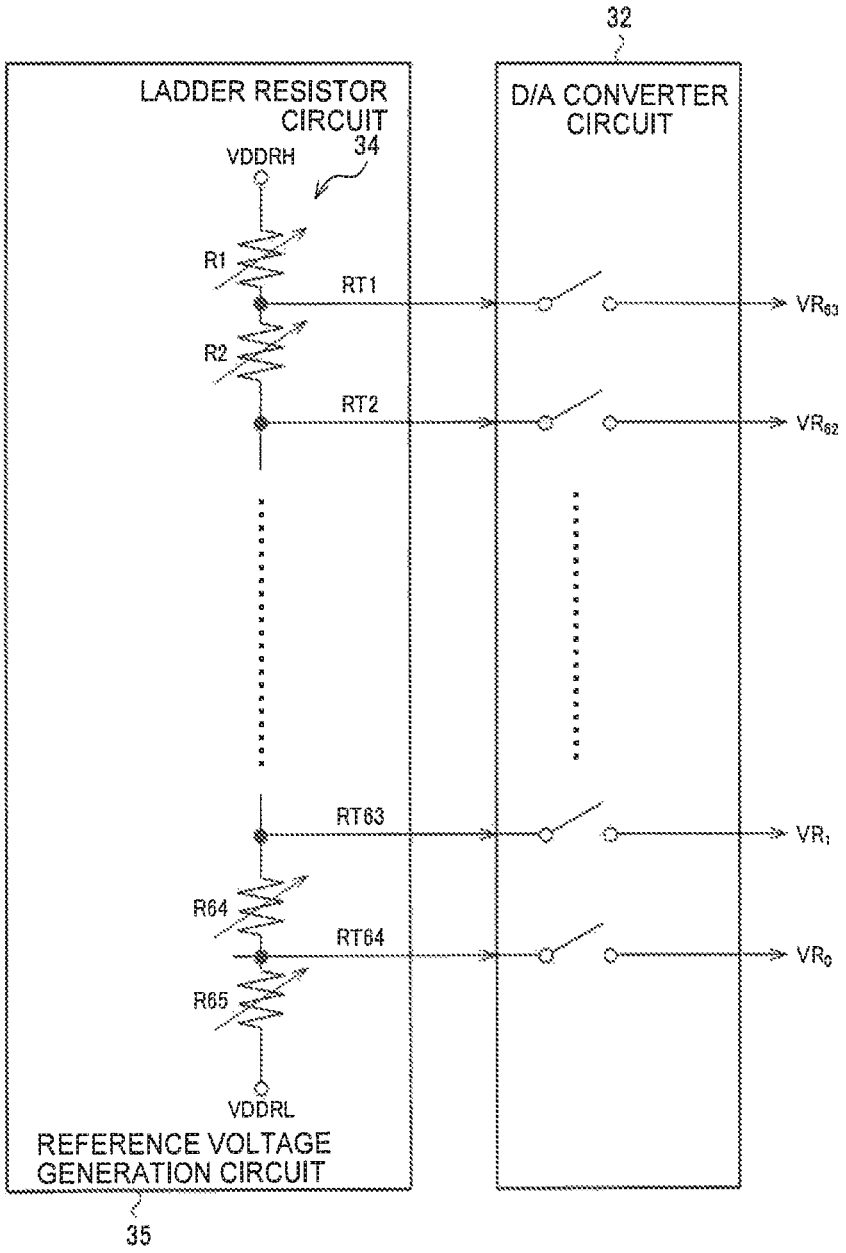
FIG. 4 shows a detailed exemplary configuration of a reference voltage generation circuit and a D/A converter circuit.

1.2 Example of Reference Voltage Generation Circuit and D/A Converter Circuit FIG. 4 shows an exemplary configuration of the reference voltage generation circuit 35 and the D/A converter circuit 32. The reference voltage generation circuit 35 is constituted by a ladder resistor circuit 34 or the like, and the D/A converter circuit 32 is constituted by switch circuits or the like.

Here, the ladder resistor circuit 34 divides the voltage between a high potential side power supply (power supply voltage) VDDRH and a low potential side power supply (power supply voltage) VDDRL by using resistors with 65 variable resistance circuits (R65 to R1) for example, and outputs a plurality of gray level voltages $VR_0$ to $VR_{63}$ to a respective plurality of resistance division nodes RT64 to RT1. Note that, although a case of 256 gray levels will also be described in the following description, the present embodiment is not limited thereto.

The D/A converter circuit 32 performs ON/OFF control on the switch circuits based on the display data, selects a reference voltage necessary for displaying the display data from the plurality of reference voltages $VR_0$ to $VR_{63}$ that are output from the reference voltage generation circuit 35, and outputs the selected reference voltage to the data line driver 40. Here, as shown in later-described FIG. 5, upper bits of the display data DG are input from the data processor 20, and the D/A converter circuit 32 selects the reference voltage based on the upper bits of the display data DG.

Note that the reference voltage generation circuit and the D/A conversion circuit are not limited to the configuration of FIG. 4, and various modifications are possible. Some of the constituent elements in FIG. 4 may be omitted, or other constituent elements may be added. For example, a positive polarity ladder resistor circuit and a negative polarity ladder resistor circuit may be provided. A circuit (operational amplifier with a voltage follower connection) that performs impedance conversion of the gray level voltage signal may be provided. Alternatively, the reference voltage generation circuit may include a selection voltage generation circuit and a reference voltage selection circuit. In this case, voltages divided by a ladder resistor circuit included in the selection voltage generation circuit are output as a plurality of selection voltages. The reference voltage selection circuit selects 64 (S, in a broad sense) voltages in the case of 256 gray levels, for example, from the selection voltages from the selection voltage generation circuit according to gray level adjustment data, and outputs selected voltages as reference voltages $VR_0$ to $VR_{63}$.

1.3 Example of Data Line Driver

Figure 5:
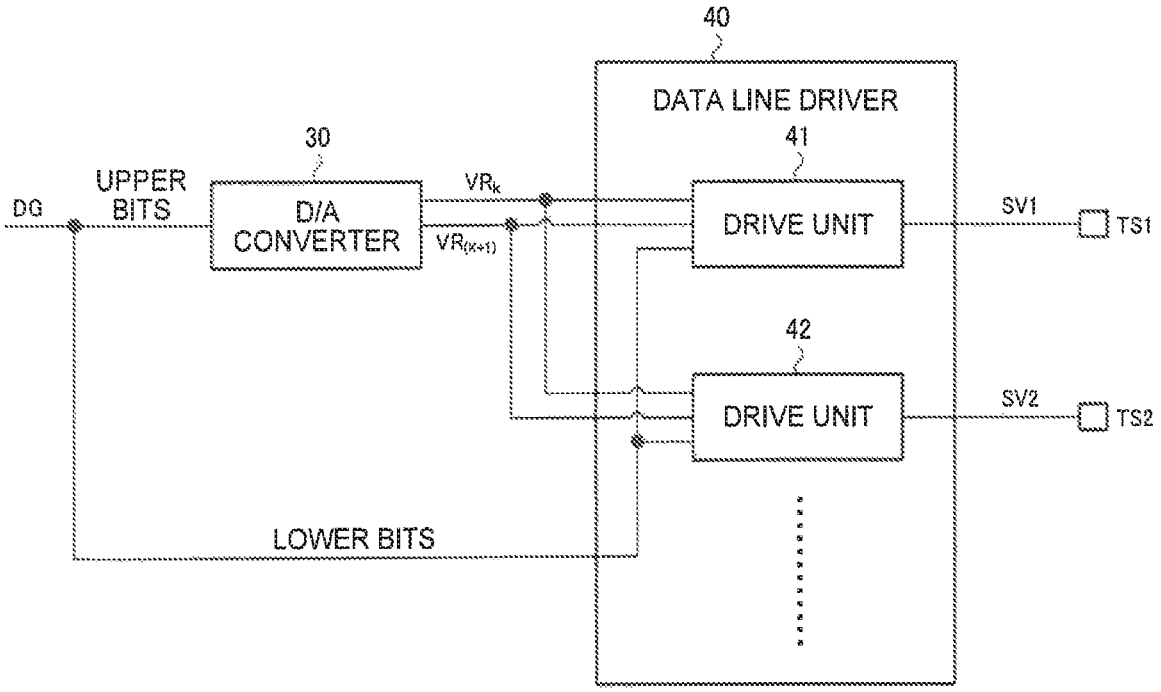
FIG. 5 shows a detailed exemplary configuration of a data line driver.

The generation of the gray level voltages will be described using FIG. 5. Upper bits of the display data DG are input tea the D/A converter 30, as described above. The upper-bit data of the display data DG is data for indicating which of the plurality of reference voltages ($VR_0$ to $VR_{63}$) that are generated by the reference voltage generation circuit 35 shown in FIG. 4 are to be used to generate the gray level voltage. In this example, the D/A converter 30 selects at least two reference voltages from the plurality of reference voltages based on the upper bits of the display data DG, For example, when a gray level on a low gray level region side is to be displayed in the electro-optical panel, the D/A converter 30 selects the voltages $VR_0$ and $VR_1$ as the reference voltages, and outputs the selected voltages $VR_0$ and $VR_1$ to the data line driver 40.

Also, the data line driver 40 includes drive units (41, 42, . . . ) for respective data lines. Two reference voltages ($VR_k$ and $VR_{k+1}$) output from the D/A converter 30 and lower bits of the display data DG are input to each drive unit. Each drive unit of the data line driver 40 generates a gray level voltage by performing voltage division using the two reference voltages based on the lower bits of the display data DG, and outputs the generated gray level voltage as a data line drive voltage (SV1 to SVn). Note that the lower bits of the display data DG form data that indicates which gray level voltage will be generated using the two reference voltages input to the data line driver 40.

To give a specific example, gray level voltages $V_0$ to $V_3$, for example, can be generated by performing voltage division using the reference voltages $VR_0$ and $VR_1$ as shown in the following equations (1) to (3).

$$V_0=VR_0 \tag{1}$$

$$V_1=VR_0+(VR_1-VR_0)\times 1/4 \tag{2}$$

$$V_2=VR_0+(VR_1-VR_0)\times 1/2 \tag{3}$$

$$V_3=VR_0+(VR_1-VR_0)\times 3/4 \tag{4}$$

In this example, the above-described lower bits of the display data DG indicate which gray level voltage is to be generated out of the gray level voltages $V_0$ to $V_3$.

2. Gamma Conversion Processing

Next, gamma conversion processing (gamma correction processing) performed by the processing circuit 120 will be described in detail with respect to each of a first embodiment and a second embodiment.

2.1 First Embodiment

In gamma conversion processing (internal gamma correction), processing in which variation in the gamma value due to a characteristic (V-T characteristic, relationship between applied voltage and transmittance) of the electro-optical panel is corrected such that the gamma value comes close to a desired value in any of the gray levels, for example, Various types of setting is possible with respect to the desired value of the gamma value, but the desired value is 2.2, for example.

Figure 6:
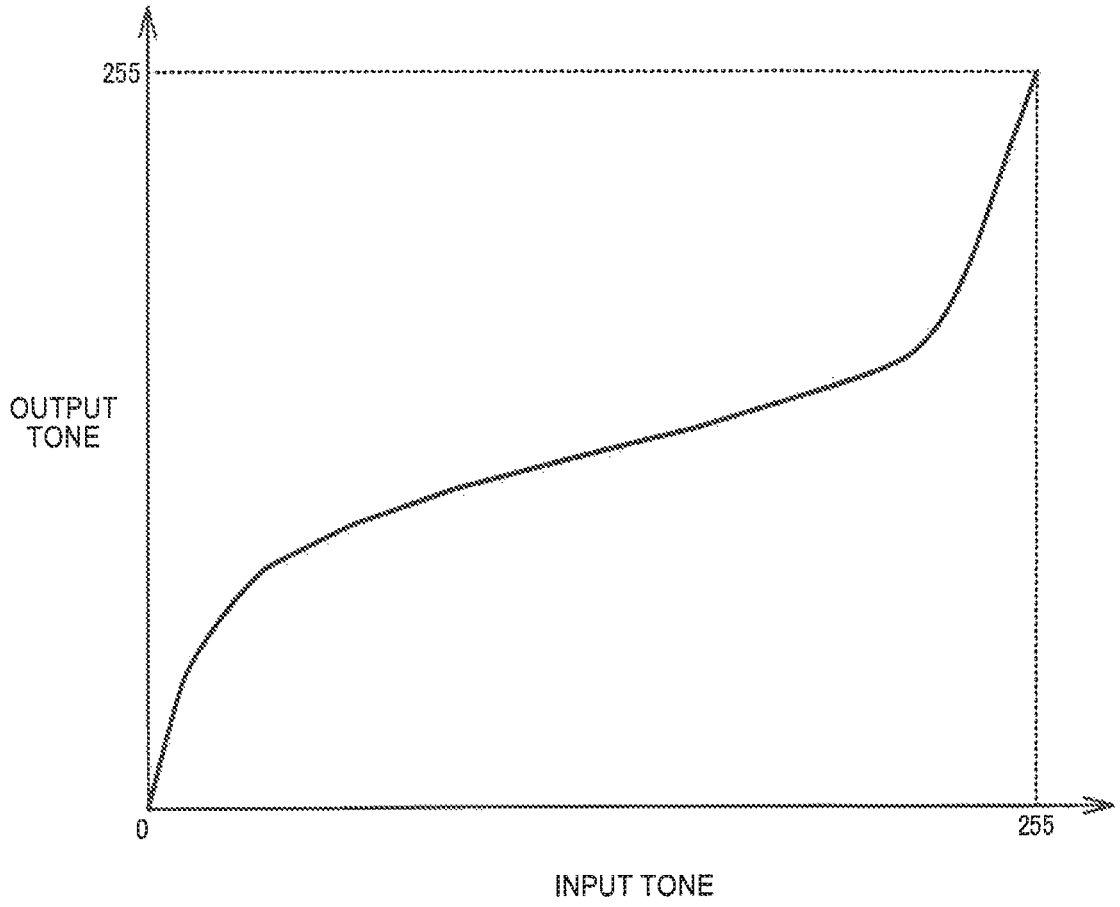
FIG. 6 shows an example of correspondence relationship between input gray levels and output gray levels.

FIG. 6 shows an example of a correspondence relationship between input gray levels and output gray levels, in the gamma conversion processing. The gamma conversion processing is realized by processing in which an input gray level (display data value) is converted to a specific gray level (output gray level) corresponding to the gray level. FIG. 6 shows an example of the correspondence relationship, and specific values are set according to the characteristic of the electro-optical panel.

In the present embodiment, an output gray level group includes output gray levels corresponding to first to $k^{th}$ (k is an integer of two or more) set points, and the processing circuit 120 performs interpolation processing based on the output gray level group so as to obtain an output gray level corresponding to an input gray level between an $i^{th}$ (i is an integer that satisfies $1 \le i < k$) set point and an $i+1^{th}$ set point.

The set point, here, is a point that indicates an input gray level with respect to which correspondence information is to be stored out of $2^m$ (256, if m=8) input gray levels. For example, in the example shown in later-described FIG. 7, the set points correspond to points such as gray level 0, gray level 8, gray level 16, gray level 32, gray level 48, and the like in the input gray level, and k=17. Also, here, the input gray level at an set point is smaller than the input gray level at an $i+1^{th}$ set point. That is, a first set point is on a low gray level region side, and a $k^{th}$ set point is on a high gray level region side. Note that various modifications with respect to the number of set points and the input gray level interval can be implemented.

In this way, the memory 130 need only store correspondence information with respect to a portion of the input gray levels in the range (0 to 255) envisioned as the input gray level. Therefore, the memory size can be reduced compared with a case where the correspondence information is stored with respect to all of the input gray levels. Also, even in a case where a gray level value that is not a set point such as gray level 1 or gray level 2 is input as the display data (input gray level), as a result of performing interpolation processing, the output gray level can be appropriately obtained. The interpolation processing, here, may be linear interpolation (straight-line interpolation) or interpolation using a given function (nonlinear function). Note that, as will be described later using FIG. 9, the processing circuit 120 may perform frame rate control (hereinafter, referred to as FRC), and decimal gray levels (gray levels obtained by further finely dividing the 256 gray levels) can also be used as the output gray level.

FIG. 7 is a diagram for describing a correspondence relationship between set points in the present embodiment and the output gray levels at the respective set points. One row in FIG. 7 represents one set point, At a first set point, the input gray level is 0, and the output gray level is also 0. Also, at a second set point, the input gray level is gray level 8, and the output gray level is gray level 12. Therefore, the processing circuit 120 may perform processing, as the gamma conversion processing, in which gray level 0 is output if the display data is gray level 0, gray level 12 is output if the display data is gray level 8, and a gray level obtained by performing interpolation processing (input gray level×1.5, with a simple linear interpolation between two points) is output if the display data is any of gray levels 1 to 7. The same is applied to other input gray levels, and the processing circuit 120 performs processing, as the gamma conversion processing, in which an output gray level corresponding to the input gray level is selected or computed using the relationship shown in FIG. 7.

As described above, it is important to reduce the memory size of the memory 130 in order to reduce the size and cost of the display driver 100, and with respect to the gamma conversion processing, there is a need to reduce the data amount of the correction data to be stored in the LUT. Specifically, in the case of the memory 130 being a non-volatile memory (PROM, for example), because the size of the PROM per unit amount of data is large relative to a register or the like, it is important to reduce the memory size in order to reduce the size of the display driver 100. Furthermore, the addition of the PROM needs to be performed in units of a certain amount of bits. That is, if the size exceeds the unit of addition of the PROM by even one bit, the size and cost of the display driver 100 is largely affected, and therefore, in the case of using a PROM, it is important to reduce the memory size as much as possible.

In the example shown in FIG. 7, as a result of the output gray level associated with each set point being data whose number of bits is smaller than eight, the memory size can be reduced. However, simply reducing the number of bits of correction data (correspondence information) reduces the accuracy of the gamma conversion processing.

In the case where the number of bits assigned to the output gray level is simply reduced in order to reduce the memory size, the increment of the output gray level increases, and therefore, there is a risk that the output gray level after gamma correction will shift from an ideal value. Alternatively, if gamma conversion processing to be performed on a specific color signal is omitted, as in JP-A-2006-133765, the gamma value with respect to the color signal largely shifts from a desired value, and as a result, there is a risk that the color will be unnatural.

Accordingly, in the present embodiment, the memory 130 of the display driver 100 stores data of lower n bits of the m-bit gray level data in the output gray level group (m and n are each an integer of two or more and n<m), and the processing circuit 120 generates output gray level data of a gray level corresponding to the m-bit gray level data based on the lower n-bit data stored in the memory 130. Also, the drive circuit 110 outputs a drive voltage of the gray level corresponding to the m-bit gray level data based on the output gray level data. The lower n bits indicate successive n-bit data from the LSB (Least Significant Bit) of the m-bit data.

Specifically, the processing circuit 120 may perform processing for restoring the ria-bit gray level data based on the lower n-bit data stored in the memory 130. In this case, the output gray level data may be the restored m-bit gray level data itself. Alternatively, as will be described using FIG. 9, the restored m-bit gray level data is multi-leveled so as to generate multi-level gray level data, and m-bit data, which is a result obtained by performing frame rate control (FRC) on the multi-level gray level data, may be the output gray level data. The restored data is stored in a register, for example. As described above, since the size of the register per unit amount of data is small relative to the memory 130 (PROM), even if the number of bits of restored data increases, the influence on the size of the display driver 100 is small. The multi-level gray level data, here, refers to data in which the increment in gray level is small (granularity is high) relative to the data before being multi-leveled. In the present embodiment, the multi-level gray level data indicates gray level data whose number of bits is larger than m, and the multi-level gray level data is 10-bit data when m=8, for example.

In this way, drive voltages of gray levels with m-bit accuracy can be output even though the data stored in the memory 130 only has n bits. Therefore, the memory size can be reduced, and the size and cost of the display driver 100 can be reduced, compared with a case where m-bit data is stored for each set point. Furthermore, the drive voltages can be set with m-bit accuracy, and therefore, a reduction in the accuracy of gamma conversion processing caused by a reduction in the memory size can be suppressed.

Hereinafter, a specific example of processing for restoring m-bit data from lower n-bit data will be described taking a case of (m, n)=(8, 6) as an example. Note that the values of m and n are not limited thereto, and various modifications such as (m, n)=(8, 7) can be implemented. Also, hereinafter, the data of an $a^{th}$ bit from the LSB is denoted as [a], and the data of bits from the $a^{th}$ bit from the LSB to a $b^{th}$ (b>a) bit from the LSB is denoted as [b:a], where the LSB is a 0th bit of 8-bit data and the MSB is a seventh bit. For example, [7:6]indicates a bit string of upper two bits of 8-bit data, and [5:0] indicates a bit string of lower six bits. Also, a number with "b" appended at the end such as 00b indicates that the number is a binary number.

FIG. 8 shows an example of the correspondence information to be stored in the memory 130. When the number of set points is assumed to be k, the correspondence information is k×n-bit (17×6-bit) data, for example. In FIG. 8, lower 6-bit data 000000b of the output gray level at the first set point is stored at a first address ad1 of the memory 130. Pieces of lower 6-bit data of output gray levels at the respective second to 17th set points are similarly stored at respective addresses ad2 to ad17 of the memory 130. That is, the memory 130 stores lower n-bit data of an output gray level at each set point, from the correspondence relationship shown in FIG. 7.

The processing circuit 120 associates the set points (input gray levels) with addresses of the memory 130 in advance. For example, the processing circuit 120 is set, in advance, so as to use, in the processing, data stored at address ad1 of the memory 130 when the display data is gray level 0. In this way, even if the correspondence information itself does not include information regarding the input gray level, the processing circuit 120 can perform gamma conversion processing using appropriate correspondence information associated with the gray level (input gray level) of the display data.

However, in the present embodiment, an 8-bit accuracy drive voltage needs to be generated, and the processing circuit 120 needs to restore 8-bit data by uniquely specifying the upper two-bit values ([7:6]). For example, when [5:0]=000000b is acquired as the data at the first set point, the processing circuit 120 needs to specify which of 00000000b, 01000000b, 10000000b, and 11000000b is the output gray level ([7:0]).

Accordingly, in the present embodiment, each piece of m-bit gray level data in the output gray level group is set to one value in a given gray level range that is narrower than $2^m$.

As shown in FIG. 7, the given gray level range, here, refers to a range that is a portion of the entire range of the output gray level ($2^m$, 0 to 255, specifically), and indicates a range in which the output gray level can be set. The given gray level range is a range that is set with respect to each address (each set point) of a plurality of addresses (set points). In the example in FIG. 7, the gray level range at the first set point (address ad1, input gray level=gray level 0) is set to gray levels 0 to 63. That is, the output gray level at the first set point is a gray level in a range from 0 to 63 inclusive, and is not a gray level in a range from 64 to 206 inclusive.

In this way, the processing circuit 120 can appropriately restore m-bit (8-bit) data from lower n-bit (6-bit) data. In the example at the first set point, only the value 00000000b, out of four values 00000000b, 01000000b, 10000000b, and 11000000b is in the settable range. As a result of setting the gray level range of the output gray level, the processing circuit 120 can output 00000000b as the 8-bit output gray level associated with the first set point.

Note that, from a viewpoint of uniquely specifying m-bit data from n-hit data, the given gray level range is a range corresponding to $2^n$ successive output gray levels. In the case of n=6, the given gray level range is a range of successive $2^6$=64 gray levels or less.

If the gray level range is 65 successive gray levels or more, a plurality of values whose lower 6 bits are the same are included in the range. For example, in the case where the gray level range with respect to the first set point is 65 gray levels, namely 0 to 64 inclusive, both values 00000000b and 01000000b are included in the gray level range. That is, the processing circuit 120 cannot specify which of the values 00000000b and 01000000b ([7:6] is 01b or 00b) is the output gray level only with the lower 6-bit data, which is [5:0]=000000b, that is acquired from the memory 130. In this regard, if the gray level range is a range corresponding to $2^n$ successive output gray levels, since the upper two-bit value is uniquely specified when lower n bits are determined in order to be in the gray level range, the processing circuit 120 can appropriately restore m-bit data. In the first set point and second to fourth set points whose gray level ranges are the same, that is, the range from 0 to 63 inclusive, [7:6]=00b regardless of the value [5:0], in FIG. 7.

Also, when the m-bit gray level data corresponding to the first output gray level in the output gray level group is set to one value in a first gray level range, and the m-bit gray level data corresponding to the second output gray level in the output gray level group is set to one value in a second gray level range, the processing circuit 120 restores the m-bit gray level data corresponding to the first output gray level by performing first restoration processing based on the lower n-bit data corresponding to the first output gray level. Also, the processing circuit 120 restores the m-bit gray level data corresponding to the second output gray level by performing second restoration processing based on the lower n-bit data corresponding to the second output gray level. In other words, the processing circuit 120 restores m-bit data from n-bit data by performing restoration processing according to the set gray level range.

For example, at a fifth set point in FIG. 7, the settable range is 64 gray levels from 16 to 79 inclusive. When this range is expressed by 8-bit binary, values from 00010000b to 01001111b inclusive are obtained. That is, a case of [7:6]=00b and a case of [7:6]=01b are included. However, since the settable range is 64 gray levels or less, once the lower 6 bits ([5:0]) are determined, the upper two bits ([7:6]) can be uniquely specified.

Specifically, the processing circuit 120 determines that [7:6]=00b if the value [5:0] is in a range from 010000b to 111111b inclusive, and determines that [7:6]=01b if the value [5:0] is in a range from 000000b to 001111b inclusive. In this example, the processing circuit 120 need not refer to all bits [5:0], and need only refer to upper two bits ([5:4]). Specifically, [7:6]=01b if [5:4]=00b, and [7:6]=00b in other cases ([5:4]=01b, 10b, 11b).

At a sixth set point in FIG. 7, the settable range is 64 gray levels from 32 to 95 (00100000b to 01011111b) inclusive. Therefore, the processing circuit 120 determines that [7:6]=00b if the value [5:0] is in a range from 100000b to 111111b inclusive, and determines that [7:6]=01b if the value [5:0] is in a range from 000000b to 011111b inclusive. More specifically, [7:6]=00b if [5]=1b, and [7:6]=01b in another case ([5]=0b).

The processing performed by the processing circuit 120 at other set points is as shown in the column "restoration processing" in FIG. 7, and a detailed description will be omitted. As can be understood from FIG. 7, which of the bits [5:0] are referred to (or not referred to), and the value [7:6] change according to the setting of the gray level range. That is, although the processing (circuit configuration of restoration processing circuit in processing circuit 120) performed by the processing circuit 120 changes according to the setting of the gray level range, the processing circuit 120 can uniquely specify m-bit data.

Note that, as shown in FIG. 7, depending on the setting of a start point (end point) in the gray level range, the bits to be referred to can be limited to a portion of the lower n bits. In the example in FIG. 7, each gray level range is set such that the gray level at the start point of the gray level range includes bits [3:0]=0000b. In this case, when the value of two bits [7:6] is to be specified, bits [3:0] of the bits [5:0] need not be referred to, and bits [7:6] can be specified using the two bits [5:4] at the maximum. That is, the restoration processing can be simplified, and as a result, the processing load can be reduced, or the scale of the circuit for performing the restoration processing can be reduced.

Figure 9:
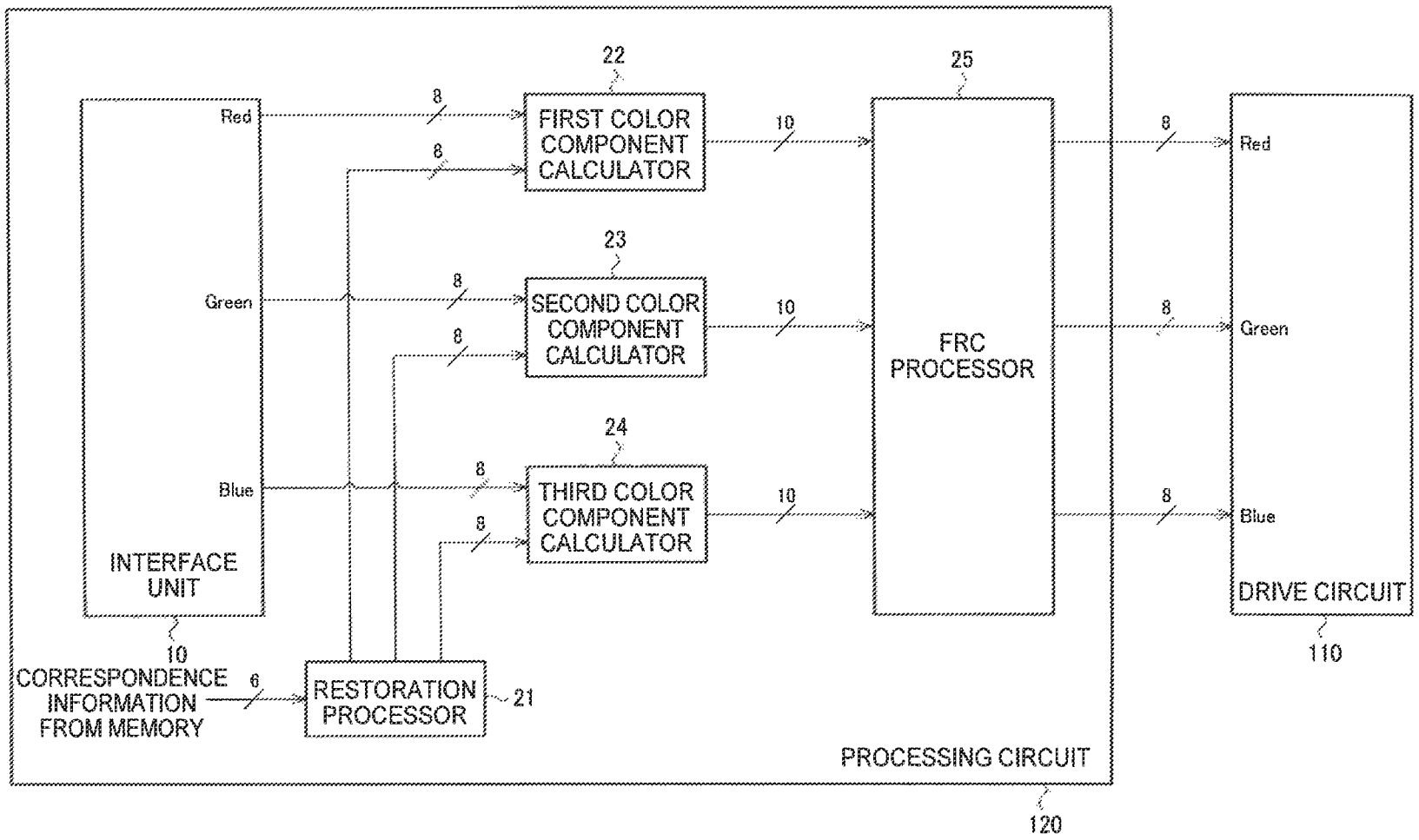
FIG. 9 shows a detailed exemplary configuration of a processing circuit.

FIG. 9 shows an exemplary configuration of the processing circuit 120 of the present embodiment. The processing circuit 120 includes a restoration processor (restoration processing circuit) 21, a first color component calculator (first color component calculation circuit) 22, a second color component calculator (second color component calculation circuit) 23, a third color component calculator (third color component calculation circuit) 24, and an FRC processor (error diffusion circuit) 25. Note that the configuration of the processing circuit 120 is not limited to the configuration shown in FIG. 9, and various modifications are possible. Some of the constituent elements in FIG. 9 may be omitted, or other constituent elements may be added.

The restoration processor 21 performs processing for restoring 8-bit (m-bit) data based on 6-bit (n-bit) data stored in the memory 130. The specific processing content has been described above. Note that, here, a case where first to third color components (R, G, and B) are used is envisioned. Therefore, the memory 130 stores correspondence information for each color component (a table in which 6-bit data is associated with each address, as shown in FIG. 8, for example), and the restoration processor 21 performs restoration processing for the first color component, restoration processing for the second color component, and restoration processing for the third color component.

The first color component calculator 22 acquires 8-bit data, which is first color component display data, that is externally input, and 8-bit data corresponding to the first color component from the restoration processor 21, and calculates the gray level value of the first color component. The first color component calculator 22 performs interpolation processing based on a plurality of (two, in a narrow sense) pieces of 8-bit data from the restoration processor 21, and calculates display data after gamma conversion processing, for example. The calculation, here, may include decimal data of m-bit data, and the calculation result is expressed by a value whose number of bits (10 bits, for example) is larger than m. That is, the first color component calculator 22 may perform multi-level gray level processing based on the input data, and output multi-level gray level data (10-bit calculation result) to the FRC processor 25. Alternatively, the first color component calculator 22 performs processing on data having a larger number of bits (11-bit data, for example) such as rounding down, rounding up, or rounding off based on the least significant bit, so as to calculate multi-level gray level data having a desired number of bits (10 bits, for example).

The second color component calculator 23 and the third color component calculator 24 similarly perform calculation processing such as interpolation processing on the respective pieces of color component display data, and output the calculation results (display data subjected to gamma conversion processing, multi-level gray level data) to the FRC processor 25.

The FRC processor 25 performs frame rate control (FRC) with respect to multi-level gray level data, and outputs 8-bit data for each color to the drive circuit 110. In FRC, an intermediate gray level is realized by changing the gray level over a plurality of frames (four frames, for example). Note that various methods, other than FRC, for expressing the intermediate gray level are known, and these methods can be widely applied in the present embodiment. For example, spatial dithering processing may be performed to express the intermediate gray level.

As described above, the processing circuit 120 generates multi-level gray level data whose number of bits is larger than m based on m-bit gray level data that is restored based on lower n-bit data and input display data, and performs frame rate control based on the generated multi-level gray level data. In this way, a gray level corresponding to decimal data of m-bit data can be expressed, and as a result, highly accurate gamma conversion processing can be realized.

Also, an example in which the processing circuit 120 restores m-bit data from n-bit data stored in the memory 130 has been described above. However, in the present embodiment, it is sufficient that the drive circuit 110 outputs m-bit accuracy drive voltages, and it is not essential that the processing circuit 120 restores m-bit data. For example, the processing circuit 120 may output a control signal (control signal for adjusting the reference voltage in the reference voltage generation circuit 35, for example) for determining a conversion range in the D/A converter circuit 32 based on n-bit data stored in the memory 130 and gray level range settings. The D/A converter circuit 32 outputs a drive voltage whose voltage is in the conversion range that is set based on the control signal, and that corresponds to n-bit digital data. In this case, although the processing circuit 120 does not directly restore m-bit data, the drive circuit 110 can output an m-bit accuracy drive voltage.

Also, the memory 130 of the present embodiment is not limited to a nonvolatile memory such as a PROM, and may also be an SRAM or a register. In this case, the correspondence information is written from an external device (CPU 310 in FIG. 13, for example) when necessary. In this case as well, the amount of data to be held in the display driver 100 can be reduced.

2.2 Second Embodiment

Details of the correspondence information in a second embodiment and an example of processing to be performed by the proses circuit 120 will be described.

In the present embodiment, the output gray level group includes first to $r^{th}$ (r is an integer of two or more) output gray levels, and the memory 130 stores the difference between an $1^{th}$ (i is an integer that satisfies $1 \leq i < r$) output gray level and an $i+1^{th}$ output gray level of the first to $r^{th}$ output gray levels as the correspondence information.

Here, the output gray level group includes gray levels corresponding to the drive voltages to be output from the drive circuit 110 as a result of gamma conversion processing, and in a narrow sense, the output gray level group is a set of output gray levels to be output from the processing circuit 120 as a result of the gamma conversion processing. More specifically, the output gray level group is a set of output gray levels associated with set points, out of the output gray levels to be output from the processing circuit 120 as a result of the gamma conversion processing. That is, when the gamma conversion processing shown in FIG. 7 is performed, the first to $r^{th}$ output levels respectively correspond to gray levels 0, 12, 23, 40, 255.

In the present embodiment, the memory 130 stores the differences between adjacent output gray levels as the correspondence information. As shown in FIG. 7, the input gray level interval (difference between input gray levels) between adjacent set points is assumed to be smaller than the entire input gray level range. In the example in FIG. 7, the input gray level interval is 32 gray levels at maximum, and the entire input gray level range is 256 gray levels. As shown in FIG. 6, the input gray level and the output gray level are not in a linear relationship in gamma correction, and even if this point is taken into consideration, the difference in output gray level between adjacent set points is expected to be smaller than the entire output gray level range. In the example in FIG. 7, the differences in output gray level are 12, 11, 17, 16, 11, and are smaller than the entire output gray level range, namely 256.

That is, in order to express the difference in output gray level, m-bit (m=8, for example) data corresponding to the entire output gray level range need not be used, and it is sufficient to use a small number of bits. For example, when the maximum difference is assumed to be 32 gray levels, the difference in output gray level can be expressed by 5-bit data. In this way, one output gray level can be expressed by data having a number of bits smaller than m, and as a result, the memory size can be reduced.

Also, the memory 130 stores m-bit (m is an integer of two or more) gray level data as an output gray level associated with at least a gray level set point of the first to $k^{th}$ set points, and the memory 130 can store the difference corresponding to a decimal gray level of the m-bit gray level data as the difference in output gray level.

FIG. 10 is a diagram showing a relationship between an input gray level value associated with each set point and the number of bits of correspondence information that indicates the output gray level associated with the set point, and one row in FIG. 10 is associated with one set point. In the example in FIG. 10, the memory 130 stores 8-bit (m-bit) data that is not a difference and corresponds to the output gray level itself as the output gray level associated with the first set point. Also, the memory 130 stores the difference from the output gray level at the first set point as the output gray level associated with the second set point.

Here, if the maximum value of the difference is assumed to be 32 gray levels, although the output gray level at the second set point needs only be 5-bit data, 7-bit data, which is two bits more, is used in FIG. 10. This additional two-bit data represents a decimal gray level. That is, in the present embodiment, the difference in output gray level may be expressed using 5-bit integer data and 2-bit decimal data. In this example, because a decimal gray level corresponding to a quarter gray level can be expressed, the processing circuit 120 can perform highly accurate gamma conversion processing. Similarly, the difference from an output gray level at a previous set point is stored as 7-bit data associated with the third set point and onward.

In this way, the memory size can be reduced, and the accuracy of gamma conversion processing can be improved. Although the memory size and the accuracy of gamma conversion processing are normally in a trade-off relationship, setting in which both of them are considered is possible.

Note that the processing circuit 120 (restoration processor 21 in FIG. 9, for example) performs processing for calculating the output gray level associated with a given input gray level based on the difference in output gray level. In the example in FIG. 10, the processing circuit 120 calculates the output gray level at the second set point by calculating the sum of the output gray level at the first set point and the difference (difference between output gray levels at the first set point and the second set point) stored in the memory 130. Similarly, the processing circuit 120 calculates the output gray level at the third set point by calculating the sum of the calculated output gray level at the second set point and the difference (difference between output gray levels at the second set point and the third set point) stored in the memory 130. The output gray level at the third set point may be considered to be obtained by calculating the total sum of the output gray level at the first set point serving as the reference and the differences up to the third set point (difference between output gray levels at the first set point and the second set point and difference between output gray levels at the second set point and the third set point).

The output gray levels at the set points thereafter can be similarly obtained, and an m-bit accuracy (or accuracy including the decimal gray level) output gray level can be obtained by performing calculation processing so as to be associated with a set point with respect to which a difference is stored as correspondence information. The output gray level obtained by calculation is to be subjected to interpolation processing by first to third color component calculators 22 to 24 and FRC performed by the ERG processor 25, in FIG. 9, and the resultant output gray level is used for outputting a drive voltage from the drive circuit 110.

Note that, although an example in which differences are stored in all of the set points other than the first set point as the correspondence information has been shown in FIG. 10, there is no limitation thereto. For example, m-bit data corresponding to the output gray level may be stored in the memory 130 with respect to each of a plurality of set points, for example.

Also, the method of the present embodiment can be combined with that of the first embodiment. That is, lower n-bit data, instead of m-bit data, may be stored in the memory 130 as the output gray level to be a reference with respect to the difference. The processing circuit 120 restores m-bit data from the lower n-bit data. Also, the processing circuit 120 calculates an output gray level (display data subjected to gamma conversion processing) corresponding to a given input gray level based on the restored m-bit data and the difference in output gray level.

2.3 Third Embodiment

There are cases where, even in the same liquid-crystal panel, the gamma characteristic (gamma value) differs depending on the gray level. Specifically, in a liquid-crystal panel, the gamma value of gray levels in a low gray level region or a high gray level region shifts from that at other regions, in many cases. In the case where the gamma value changes for each gray level, a smooth hue change or the like cannot be expressed in a liquid-crystal panel in a region close to the change point in gamma value. Also, a user will recognize this as a gray level jump, color shift, and color stain, in many cases.

In the case where the input gray level at the first set point is gray level 0, and the input gray level at the second set point is gray level 8, as shown in FIG. 10, when a gray level in a range from gray level 1 to gray level 7, which is in the low gray level region, is input, the processing circuit 120 obtains the output gray level by performing interpolation processing. In an intermediate gray level region, the shift in gamma value is small even with a simple linear interpolation, but in the low gray level region, there is a risk that the shift in gamma value due to interpolation processing will increase, and the above-described gray level jump or the like will occur. The same applies to the high gray level region from a $16^{th}$ set point (input gray level=gray level 248) to a $17^{th}$ set point (input gray level-gray level 255) in FIG. 10.

Therefore, in the present embodiment, the output gray level group includes output gray levels associated with first to $k^{th}$ (k is an integer of two or more) set points, and the input gray level interval between set points of the first to $p^{th}$ set points is smaller than the input gray level interval between set points of the $p^{th}$ to ($_i^t$ set points (p and q are integers that satisfy $1<p<q<k$). Also, the input gray level interval between set points of the $q^{th}$ to $k^{th}$ set points is smaller than the input gray level interval between set points of the $p^{th}$ to $q^{th}$ set points.

FIG. 11 is a diagram illustrating a relationship between an input gray level value associated with each set point and the number of bits of correspondence information that indicates the output gray level associated with the set point, and one row in FIG. 11 is associated with one set point. In the example in FIG. 11, k=30, p=9, and q=23, but various modifications with respect to values of k, p, and q are possible.

As shown in FIG. 11, the input gray level interval in a range from first to $p^{th}$ (first to ninth) set points and in a range from $q^{th}$ to $k^{th}$ ($23^{th}$ to $30^{th}$) set points is one gray level. In contrast, the input gray level interval in a range from $p^{th}$ to $q^{th}$ (ninth to $23^{th}$) set points is 8, 16, or 32 gray levels, which is greater than one gray level.

In this way, in a gray level region in which the gamma value is likely to shift, the number of set points can be increased, and the accuracy of gamma conversion processing can be improved. The more the input gray level interval decreases, the more a reduction in accuracy of gamma conversion processing due to interpolation processing can be suppressed. Specifically, when the input gray level interval is set to one, as shown in FIG. 11, the interpolation processing becomes unnecessary in the low gray level region and in the high gray level region, and therefore the shift in gamma value can be suppressed.

However, when the input gray level interval is decreased, the number of set points increases, and therefore, the data amount of correspondence information to be stored in the memory 130 increases. In this regard, in the present embodiment, similarly to the second embodiment, the memory 130 stores the difference in output gray level as the correspondence information.

If the input gray level interval is small, the difference in output gray level is considered to be small. For example, in the above-described example, when the input gray level interval is 8, 16, or 32 gray levels, the difference in output gray level is considered to be smaller than 32 gray levels, and therefore 5-bit data (or 7-bit data including decimal) is assigned to express the difference. However, if the input gray level interval is one gray level, the difference in output gray level must be smaller than 32 gray levels, and may be considered to be about four gray levels, for example. That is, as shown in FIG. 11, in the first to $p^{th}$ set points, it is sufficient to use 4-bit (2-bit integer and 2-bit decimal) data to express the difference in output gray level, even if a decimal gray level (quarter gray level) is included.

In a broad sense, the difference between an output gray level at an $s^{th}$ (s is an integer that satisfies $1 \leq s < p$) set point and an output gray level at an $s+1^{th}$ set point is stored in the memory 130 as correspondence information that is associated with at least a gray level set point of the first to $p^{th}$ (p is an integer that satisfies $1<p<k$) set points. For example, at any one set point of the first to $p^{th}$ set points, m-bit (8-bit) data is stored as the output gray level, and 4-bit difference information, with this output gray level being the reference, is stored as the correspondence information at each of the other $p-1$ set points. In the example in FIG. 11, m-bit (8-bit) data is stored at the first set point as the output gray level, and this output gray level is used as the reference.

Note that the output gray level at a set point other than the first set point may be expressed by m-bit data (as the reference output gray level), Also, a modification in which an m-bit output gray level is stored at two or more set points of the first to $p^{th}$ set points (the number of set points with respect to which a difference is stored is reduced) is possible. Alternatively, a difference in output gray level may be stored as the correspondence information with respect to all of the first to $p^{th}$ set points using the output gray level at any of $p^{th}$ to $k^{th}$ set points as the reference.

Similarly, the difference between the output gray level at a $t^{th}$ (t is an integer that satisfies $q \leq t < k$) set point and the output gray level at a $t_{+}1^{th}$ set point is stored in the memory 130 as the correspondence information associated with at least a gray level set point of $q^{th}$ (q is an integer that satisfies $1<q<k$) to set points. In the example in FIG. 11, m-bit (8-bit) data is stored as the output gray level at the $k^{th}$ set point, and 4-bit difference data, with this output gray level being the reference, is stored as the correspondence information at each of $q^{th}$ to $k-1^{th}$ set points.

As described above, in the method of the present embodiment, a difference in output gray level is stored in the memory 130 as the correspondence information in at least a portion of the low gray level region and the high gray level region. Although the memory size increases in the case where the accuracy is increased by decreasing the input gray level interval in a gray level region in which a shift in gamma value is likely to occur, the increase in memory size can be suppressed by storing the difference in output gray level in the memory 130. Specifically, the smaller the input gray level interval, the more the number of bits of data that express the difference can be decreased, and therefore, the increase in memory size can be efficiently suppressed using the method of the present embodiment.

For example, the method in JP-A-2006-133765 discloses a method in which the difference between input data (input gray level) and data (output gray level) after correction is stored. However, the relationship between the input gray level and the output gray level is determined by the characteristics of an electro-optical panel (above-describe FIG. 6, for example). Therefore, the magnitude of a difference between an input gray level and the output gray level associated therewith does not relate to the input gray level interval between set points. In other words, with the method in JP-A-2006-133765, a predetermined number of bits need to be used as the data to express the difference between an input gray level and the output gray level associated therewith regardless of the input gray level interval. In contrast, the difference in the method of the present embodiment refers to the difference in output gray level between adjacent set points. Therefore, if the input gray level interval decreases, the number of bits of difference data can be reduced. That is, with the method of the present embodiment, the accuracy in gamma conversion processing can be increased, and the memory size can be efficiently reduced, compared with the method in JP-A-2006-133765.

Note that, an example in which m-bit (8-bit) data is stored as the correspondence information with respect to each of tenth to $22^{nd}$ set points without using the difference is shown in FIG. 11. In other words, in FIG. 11, the gray level region in which the difference in output gray level is stored as the correspondence information is limited to the low gray level region and the high gray level region. However, the method of the present embodiment is not limited to this.

FIG. 12 is a diagram illustrating another relationship between an input gray level value associated with each set point and the number of bits of correspondence information that indicates the output gray level associated with the set point. As shown in FIG. 12, the difference in output gray level can be used as the correspondence information not only in a region in which the input gray level interval is relatively small (low gray level region and high gray level region), but also in a region in which the input gray level interval is relatively large.

In the example in FIG. 12, m-bit (8-bit) data is stored in the memory 130 as the output gray level at the first set point. Also, at each of the second to $k^{th}$ ($30^{th}$) set points, the difference in output gray level from the previous set point is stored as the correspondence information. At the second to ninth set points and the $24^{th}$ to $30^{th}$ set points at which the input gray level interval from the previous set point is small, the number of bits of correspondence information is relatively small (4 bits), and at the tenth to $23^{rd}$ set points at which the input gray level interval is large, the number of bits of correspondence information is relatively large (7 bits).

Note that, in the example in FIG. 12, the first set point is the only set point for which a reference output gray level (m-bit data) is stored, and therefore, with respect to all of the second to $30^{th}$ set points, the difference in output gray level from the previous set point is the correspondence information. Note that, as shown in FIG. 11, a reference output gray level (m-bit data) may be stored at each of the first set point and the $30^{th}$ set point. In this case, the target with respect to which the difference is to be calculated may be the previous set point or the next set point.

Also, a method in which the input gray level interval is reduced in both the low gray level region and the high gray level region, and the difference in output gray level is stored as the correspondence information has been described above. Specifically, information regarding the difference between the output gray level at an $s^{th}$ set point and the output gray level at an $s+1^{th}$ set point is stored in the memory 130 as the correspondence information associated with at least a gray level set point of the first to $p^{th}$ set points, and information regarding the difference between the output gray level at a $t^{th}$ set point and the output gray level at a $t+1^{th}$ set point is stored as the correspondence information associated with at least a gray level set point of the $q^{th}$ to $k^{th}$ set points. Also, the input gray level interval of the first to set points is smaller than the input gray level interval of the $p^{th}$ to $q^{th}$ set points, and the input gray level interval of the $q^{th}$ to $k^{th}$ set points is smaller than the input gray level interval of the $p^{th}$ to $q^{th}$ set points.

Note that the method of the present embodiment is not limited to this, and the region in which the input gray level interval is reduced may be one of the low gray level region and the high gray level region In the case where the input gray level interval is reduced only in the low gray level region, the difference in output gray level may be stored in the memory 130 as the correspondence information in at least a portion of the low gray level region. That is, in the high gray level region in which the input gray level interval is not reduced, m-bit data (output gray level itself) instead of the difference in output gray level may be stored as the correspondence information.

Also, the method of the present embodiment can be combined with the first embodiment. That is, lower n-bit data instead of all of the m-bit data may be stored in the memory 130 as the output gray level, which is a reference with respect to the difference.

2.4 Writing of Correspondence Information Into Memory

Various timings are conceivable at which the correspondence information is to be written into the memory 130. For example, the correspondence information may be written when the display driver 100 is manufactured (adjusted), or the correspondence information may be written when an electro-optical device 350 including the display driver 100 is manufactured, for example. That is, the user who writes the correspondence information into the memory 130 may be a manufacturer of the display driver 100, or a manufacturer of the electro-optical device 350. Also, the correspondence information may be written (or re-written) by another user at another timing.

Here, a user may input data before the number of bits is reduced into the display driver 100 (processing circuit 120), and the processing circuit 120 may obtain the correspondence information in each embodiment based on the input data. For example, in the first embodiment, the processing circuit 120 receives m-bit (8-bit) data for each set point, and performs processing in which lower n-bit (6-nit) data is extracted, and the extracted data is written into the memory 130 as the correspondence information. In the second and third embodiments, the processing circuit 120 receives m-bit (8-bit) data for each set point, and calculates a difference in data between adjacent set points. Also, the processing circuit 120 performs processing in which m-bit data itself or difference data (4-bit or 7-bit data, in the above-described examples), which is obtained by calculation, whose number of bits is smaller than m is written into the memory 130 as the correspondence information for each set point.

In this way, a user need not be aware of the specific data format in the memory 130, and therefore the write processing of the correspondence information can be facilitated. For example, in the first embodiment, the user need only input a value in a gray level range that is determined in advance for each set point into the display driver 100 as the output gray level, and need not consider which bits will be stored in the memory 130.

Note that the method of the present embodiment is not limited to this, and lower n-bit data or a difference in output gray level may be directly transmitted to the display driver 100. In this case, extraction of bits a d calculation of the difference may be performed in an external apparatus that performs write processing into the memory 130, for example.

3. Display Controller, Electro-Optical Device, and Electronic Apparatus

An example in which the display driver 100 includes the processing circuit 120 that performs data processing on the display data and timing control has been described above. This example corresponds to an example in which the display controller 300 is incorporated in the display driver 100. Note that the application of the r Method of the present embodiment is not limited to this, and the method can be applied to the above-described display controller 300 that performs the gamma conversion processing.

The display controller 300 includes the processing circuit 120 that performs gray level gamma conversion processing on display data and the memory 130 that stores correspondence information between an input gray level group and an output gray level group in the gamma conversion processing. Also, the memory 130 stores lower n-bit data of m-bit gray level data in the output gray level group (m and n are each an integer of two or more and $n<m$), and the processing circuit 120 restores the m-bit gray level data based on the lower n-bit data stored in the memory 130.

In this way, while reducing the size of the memory 130, m-bit accuracy gamma conversion processing can be performed. Therefore, the size and cost of the display controller 300 can be reduced.

Also, the method of the present embodiment can be applied to an electro-optical device 350 including the above-described display driver 100 and an electro-optical panel 200. Alternatively, the method of the present embodiment can be applied to an electronic apparatus including the above-described display driver 100 or display controller 300.

Figure 13:
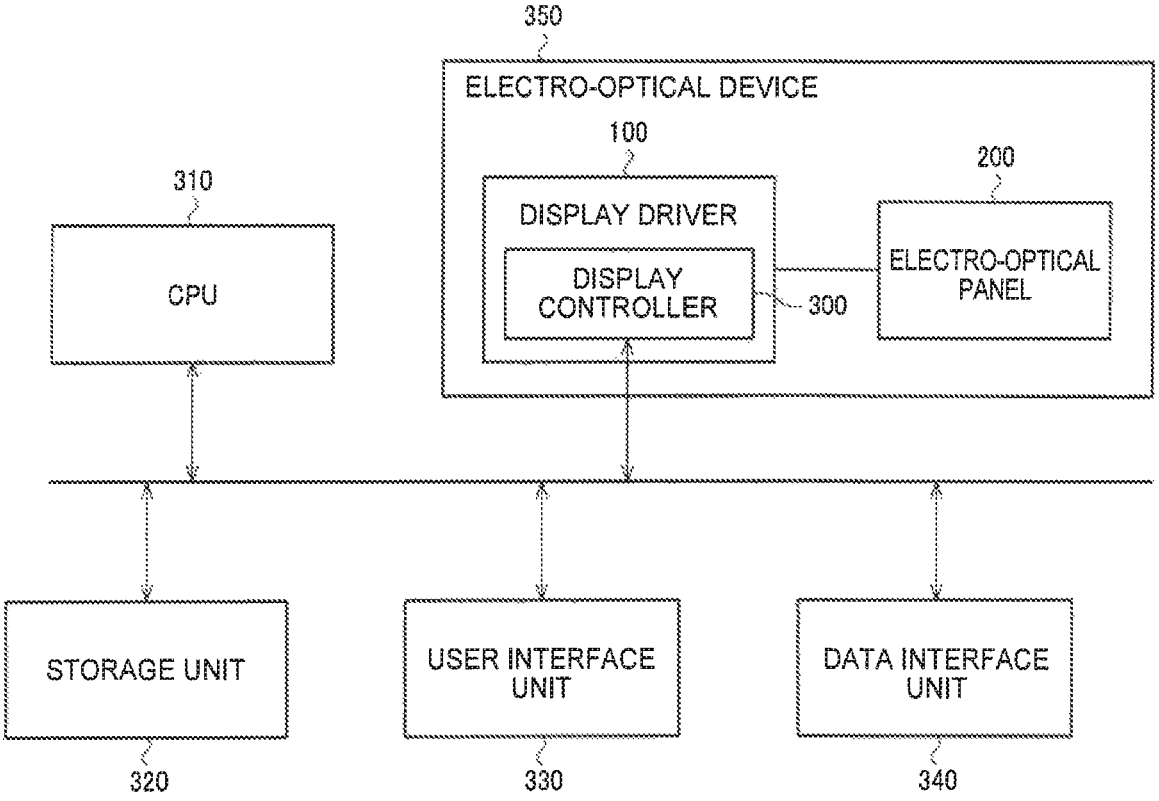
FIG. 13 shows an exemplary configuration of an electronic apparatus and an electro-optical device.
Figure 14:
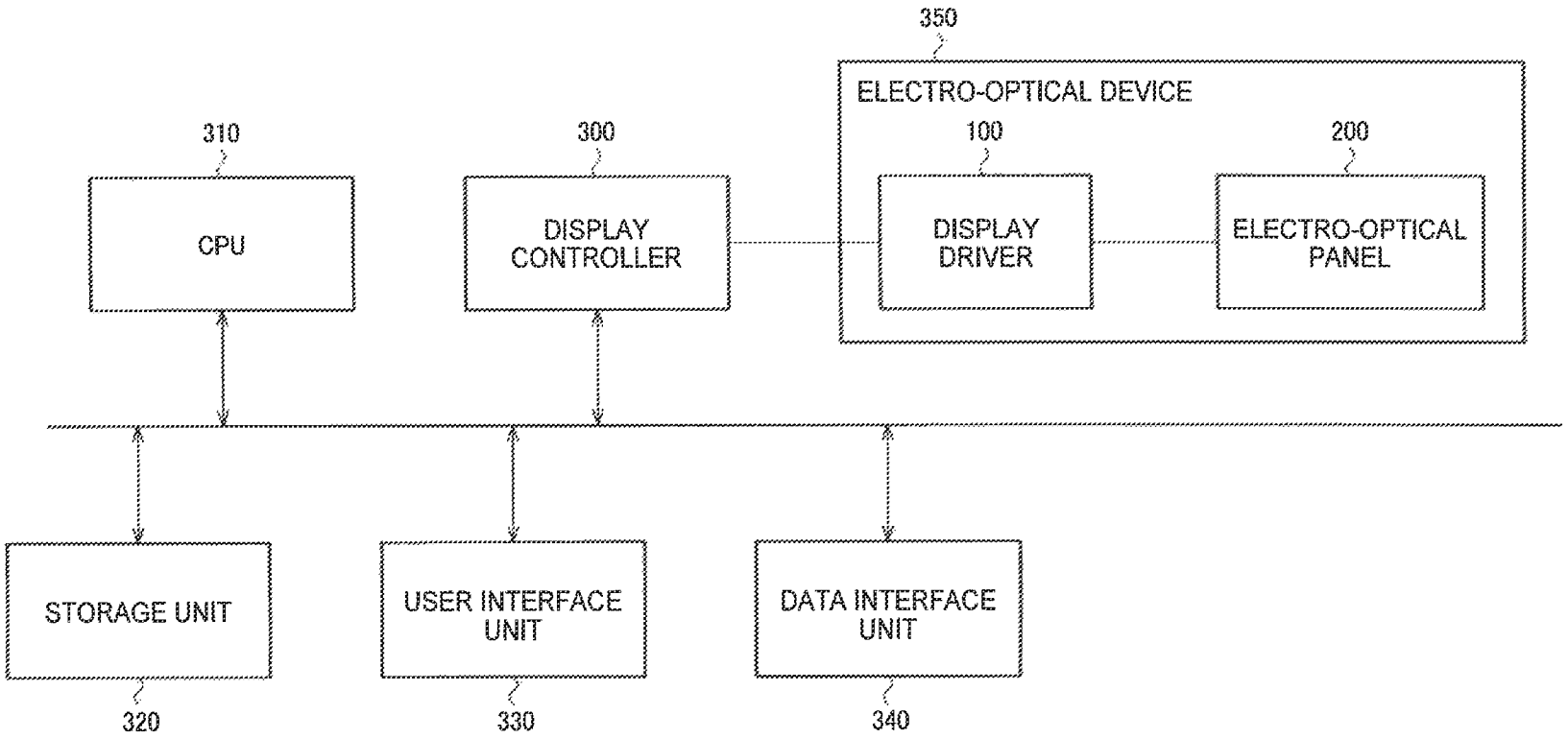
FIG. 14 shows an exemplary configuration of an electronic apparatus and an electro-optical device.

Exemplary configurations of an electro-optical device and an electronic apparatus to which the method of the present embodiment can be applied are shown in FIGS. 13 and 14. As shown in FIG. 13, the display driver 100 of the present embodiment may be configured to include the display controller 300, or the display driver 100 and the display controller 300 may be separately provided, as shown in FIG. 14. Hereinafter, an example in FIG. 14 will be described.

Various electronic apparatuses, on which a display device is mounted, such as an on-board display device (such as a meter panel, for example), a monitor, a display, a single-panel projector, a television device, an information processing device (computer), a mobile information terminal, a car navigation system, a mobile game terminal, a DLP (Digital Light Processing) device, and a printer, for example, can be envisioned as an electronic apparatus including the display driver 100 or the display controller 300 according to the present embodiment.

An electronic apparatus shown in FIG. 14 includes an electro-optical device 350, a CPU 310 (a processing device, in a broad sense), a display controller 300 (host controller), a storage unit 320, a user interface unit 330, and a data interface unit 340. The electro-optical device 350 includes a display driver 100 and an electro-optical panel 200.

The electro-optical panel 200 is a matrix type liquid crystal display panel, for example. Alternatively, the electro-optical panel 200 may be an EL (Electro-Luminescence) display panel using a self-luminous element. For example, the electro-optical panel 200 may be a display panel (organic EL display) using an organic light-emitting diode (OLED). For example, the electro-optical panel 200 is formed on a glass substrate, and the display driver 100 is mounted on the glass substrate. The electro-optical device 350 is configured as a module including the electro-optical panel 200 and the display driver 100 (the electro-optical device 350 may further include the display controller 300). Note that the display controller 300 and the display driver 100 may be incorporated in the electronic apparatus as separate components instead of being configured as a module.

The user interface unit 330 is an interface unit for accepting various operations from a user. The user interface unit 330 is constituted by a button, a mouse, a keyboard, a touch panel installed in the electro-optical panel 200, or the like, for example. The data interface unit 340 is an interface unit that performs receiving and outputting of display data and control data. The data interface unit 340 is a wired communication interface such as a USB or a wireless communication interface such as a wireless LAN, for example. The storage unit 320 stores display data that is input from the data interface unit 340. Alternatively, the storage unit 320 functions as a work memory for the CPU 310 and the display controller 300. The CPU 310 performs control processing on the units of the electronic apparatus and various data processing. The display controller 300 performs control processing on the display driver 100. For example, the display controller 300 converts the display data transmitted from the data interface unit 340 or the storage unit 320 via the CPU 310 to a format acceptable to the display driver 100, and outputs the converted display data to the display driver 100. The display driver 100 drives the electro-optical panel 200 based on the display data transmitted from the display controller 300.

Note that, although the present embodiment has been described above in detail, those skilled in the art will easily understand that various modifications are possible without substantially departing from the new matter and the effect of the invention. Accordingly, all those modifications are to be encompassed in the scope of the invention. For example, a term that is used at least once together with another term having a broader or the same meaning in the specification or the drawings may be replaced with another term in any part of the specification or the drawings. Configurations, operations, or the like of the display driver, the display controller, the electro-optical device, and the electronic apparatus are not limited to those described in the present embodiment either, and may be modified in various manners.

What is claimed is:

1. A display driver comprising:

a processing circuit configured to perform gamma conversion processing on display data with respect to gray level;

a memory that stores correspondence information between an input gray level group and an output gray level group that is used in the gamma conversion processing; and a drive circuit configured to output a drive voltage based on the display data subjected to the gamma conversion processing, wherein the memory stores lower n bits of m-bit gray level data in the output gray level group, where m and n are each an integer having a value of at least 2 and $n<m$, the processing circuit is configured to generate output gray level data corresponding to the m-bit gray level data based on the lower n-bit data stored in the memory, and the drive circuit is configured to output the drive voltage based on the output gray level data.

2. The display driver according to claim 1, wherein the m-bit gray level data in the output gray level group is set to one value in a gray level range including successive $2^m$ values.

3. The display driver according to claim 2, wherein the gray level range is a successive range corresponding to $2^n$ output gray levels.

4. The display driver according to claim 1, wherein the processing circuit is configured to perform processing for restoring the m-bit input gray level data based on the lower n-bit data stored in the memory.

5. The display driver according to claim 4, wherein, when the m-bit gray level data corresponding to a first output gray level in the output gray level group is set to one value in a first gray level range, and the m-bit gray level data corresponding to a second output gray level in the output gray level group is set to one value in a second gray level range, the processing circuit is configured to:

restore the m-bit gray level data corresponding to the first output gray level by performing first restoration processing based on the lower n-bit data corresponding to the first output gray level, and restore the m-bit gray level data corresponding to the second output gray level by performing second restoration processing based on the lower n-bit data corresponding to the second output gray level.

6. The display driver according to claim 4, wherein the processing circuit is configured to generate multi-level gray level data whose number of bits is larger than m based on the m-bit gray level data that has been restored based on the lower n-bit data and the display data that has been input, and perform frame rate control based on the multi-level gray level data that has been generated.

7. The display driver according to claim 1, wherein the output gray level group includes output gray levels respectively associated with first to $k^{th}$ set points, where k is an integer having a value of at least 2, and the processing circuit is configured to perform processing for obtaining the output gray level corresponding to an input gray level between an $i^{th}$ set point and an $i+1^{th}$ set point by performing interpolation processing based on the output gray level group, where i is an integer having a value that satisfies $1<i<k$.

8. A display driver comprising:

a processing circuit configured to perform gamma conversion processing on display data with respect to gray level; and a memory that stores correspondence information between an input gray level group and an output gray level group that is used in the gamma conversion processing, wherein the output gray level group includes first to $r^{th}$ output gray levels, where r is an integer having a value of at least 2, the memory stores a difference between an $i^{th}$ output gray level and an $i+1^{th}$ output gray level of the first to $r^{th}$ output gray levels as the correspondence information, where i is an integer having a value that satisfies $1<i<r$, the output gray level group includes output gray levels associated with first to $k^{th}$ set points, and the memory stores a difference between the output gray level at a $t^{th}$ set point and the output gray level at an $t+1^{th}$ set point as the correspondence information associated with at least a gray level set point of $q^{th}$ to $k^{th}$ set points, where k is an integer having a value of at least 2, t is an integer having a value that satisfies $q<t<k$, and q is an integer having a value that satisfies $1<q<k$.

9. The display driver according to claim 8, the memory stores a difference between the output gray level at an $s^{th}$ set point and the output gray level at an $s+1^{th}$ set point as the correspondence information associated with at least a gray level set point of first to $p^{th}$ set points, where s is an integer having a value that satisfies $1<s<p$, and p is an integer having a value that satisfies $1<p<k$.

10. The display driver according to claim 8, an input gray level interval in first to $p^{th}$ set points is smaller than the input gray level interval in $p^{th}$ to $q^{th}$ set points, where p and q are integers having a value that satisfy $1<p<q<k$, and the input gray level interval in $q^{th}$ to $k^{th}$ set points is smaller than the input gray level interval in the $p^{th}$ to $q^{th}$ set points.

11. A display driver comprising:

a processing circuit configured to perform gamma conversion processing on display data with respect to gray level; and a memory that stores correspondence information between an input gray level group and an output gray level group that is used in the gamma conversion processing, wherein the output gray level group includes first to $r^{th}$ output gray levels, where r is an integer having a value of at least 2, the memory stores a difference between an $i^{th}$ output gray level and an $i+1^{th}$ output gray level of the first to $r^{th}$ output gray levels as the correspondence information, where i is an integer having a value that satisfies $1<i<r$, the output gray level group includes output gray levels associated with first to $k^{th}$ set points, where k is an integer having a value of at least 2, when p and q are integers that satisfy $1<p<q<k$, s is an integer that satisfies $1<s<p$, and t is an integer that satisfies $q<t<k$, the memory stores:

a difference between the output gray level at an $s^{th}$ set point and the output gray level at an $s+1^{th}$ set point as the correspondence information associated with at least a gray level set point of first to $p^{th}$ set points, and a difference between the output gray level at a $t^{th}$ set point and the output gray level at an $t+1^{th}$ set point as the correspondence information associated with at least a gray level set point of $q^{th}$ $k^{th}$ set points, and an input gray level interval in the first to $p^{th}$ set points is smaller than the input gray level interval in $p^{th}$ to $q^{th}$ set points, and the input gray level interval in the $q^{th}$ to $k^{th}$ set points is smaller than the input gray level interval in the $p^{th}$ to $q^{th}$ set points.

12. The display driver according to claim 9, wherein the memory stores m-bit (m is an integer of two or more) gray level data as the output gray level associated with at least a gray level set point of the first to $k^{th}$ set points, where m is an integer having a value of at least 2, and the memory is capable of storing the difference corresponding to a decimal gray level of the m-bit gray level data as the difference in the output gray level.

13. The display driver according to claim 12, wherein the processing circuit is configured to perform processing of calculating the output gray level corresponding to a given input gray level based on the difference in the output gray level.

14. A display controller comprising:

a processing circuit configured to perform gamma conversion processing on display data with respect to gray level; and a memory that stores correspondence information between an input gray level group and an output gray level group that is used in the gamma conversion processing, wherein the memory stores lower n bits of m-bit gray level data in the output gray level group, where m and n are each an integer having a value of at least 2, and $n<m$, and the processing circuit is configured to generate the m-bit gray level data based on lower n-bit data stored in the memory.

15. An electro-optical device comprising:

the display driver according to claim 1; and an electro-optical panel.

16. An electronic apparatus comprising the display driver according to claim 1.

17. An electronic apparatus comprising the display controller according to claim 14.

18. A display driver comprising:

a processing circuit configured to perform gamma conversion processing on display data with respect to gray level; and a memory that stores correspondence information between an input gray level group and an output gray level group that is used in the gamma conversion processing, wherein the output gray level group includes first to $r^{th}$ output gray levels, where r is an integer having a value of at least 2, the memory stores a difference between adjacent output gray levels as the correspondence information, the output gray level group includes output gray levels associated with first to $k^{th}$ set points, and the memory stores a difference between the output gray level at a $t^{th}$ set point and the output gray level at an $t+1^{th}$ set point as the correspondence information associated with at least a gray level set point of $q^{th}$ to $k^{th}$ set points, where k is an integer having a value of at least 2, t is an integer having a value that satisfies $q<t<k$, and q is an integer having a value that satisfies $1<q<k$.

19. A display driver comprising:

a processing circuit configured to perform gamma conversion processing on display data with respect to gray level; and a memory that stores correspondence information between an input gray level group and an output gray level group that is used in the gamma conversion processing, wherein the output gray level group includes first to $r^{th}$ output gray levels, where r is an integer having a value of at least 2, the memory stores a difference between adjacent output gray levels as the correspondence information, the output gray level group includes output gray levels associated with first to $k^{th}$ set points, where k is an integer having a value of at least 2, when p and q are integers that satisfy $1<p<q<k$, s is an integer that satisfies $1<s<p$, and t is an integer that satisfies $q<t<k$, the memory stores:

a difference between the output gray level at an $s^{th}$ set point and the output gray level at an $s+1^{th}$ set point as the correspondence information associated with at least a gray level set point of first to $p^{th}$ set points, and a difference between the output gray level at a $t^{th}$ set point and the output gray level at an $t+1^{th}$ set point as the correspondence information associated with at least a gray level set point of $q^{th}$ to $k^{th}$ set points, and an input gray level interval in the first to $p^{th}$ set points is smaller than the input gray level interval in $p^{th}$ to $q^{th}$ set points, and the input gray level interval in the $q^{th}$ to $k^{th}$ set points is smaller than the input gray level interval in the $p^{th}$ to $q^{th}$ set points.

* * * * *